US009457978B2

(12) United States Patent
Koda et al.

(10) Patent No.: US 9,457,978 B2
(45) Date of Patent: Oct. 4, 2016

(54) ARTICLE DELIVERY SYSTEM

(71) Applicant: CANON KABUSHIKI KAISHA, Tokyo (JP)

(72) Inventors: Takeshi Koda, Kawasaki (JP); Kazuhiko Onuki, Tokyo (JP); Masaharu Shimakawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/859,620

(22) Filed: Sep. 21, 2015

(65) Prior Publication Data

US 2016/0090259 A1 Mar. 31, 2016

(30) Foreign Application Priority Data

Sep. 30, 2014 (JP) ..... 2014-200733
Feb. 23, 2015 (JP) ..... 2015-033146

(51) Int. Cl.
*G06F 7/00* (2006.01)
*B65H 29/00* (2006.01)
*B41J 13/10* (2006.01)

(52) U.S. Cl.
CPC ..... *B65H 29/00* (2013.01); *B41J 13/10* (2013.01)

(58) Field of Classification Search
None
See application file for complete search history.

(56) References Cited

U.S. PATENT DOCUMENTS 4,718,657 A * 1/1988 Otter ..... B65H 9/10 271/184
6,520,634 B2 2/2003 Yoshinaga et al.
2008/0317498 A1* 12/2008 Andoh ..... G03G 15/60 399/110

FOREIGN PATENT DOCUMENTS

JP 2006-315867 A 11/2006

* cited by examiner

*Primary Examiner* — Yolanda Cumbess
(74) *Attorney, Agent, or Firm* — Fitzpatrick, Cella, Harper & Scinto

(57) ABSTRACT

The delivery system has a supply device having a supply port for supplying an article; a receiving device having a receiving port that is able to receive the article that is supplied from the supply port; and a detection unit that is capable of detecting: a first state in which the supply device and the receiving device are joined by the supply port engaging with the receiving port; a second state in which the supply device and the receiving device are close together and there is a space between the supply port and the receiving port; and a third state in which the supply device and the receiving device are separated and the space between the device is wider than in the second state.

14 Claims, 27 Drawing Sheets

| SENSOR 69 STATE | SENSOR 70 STATE | STACKER STATE | PRINTER PRINTING OPERATION |
|---|---|---|---|
| UNDETECTED | UNDETECTED | SEPARATED | PRINTING CAN BE STARTED |
| UNDETECTED | DETECTED | CLOSE | PRINTING CANNOT BE STARTED |
| DETECTED | DETECTED | JOINED | PRINTING CAN BE STARTED |
| DETECTED | UNDETECTED | UNCLEAR | PRINTING CANNOT BE STARTED |

FIG.15

| SENSOR 69 STATE | SENSOR 70 STATE | SENSOR 67 STATE | SENSOR 68 STATE | STACKER STATE | PRINTER PRINTING OPERATION |
|---|---|---|---|---|---|
| UNDETECTED | UNDETECTED | UNDETECTED | UNDETECTED | SEPARATED | PRINTING CAN BE STARTED |
| UNDETECTED | UNDETECTED | UNDETECTED | DETECTED | CLOSE (DIAGONAL) | PRINTING CANNOT BE STARTED |
| UNDETECTED | UNDETECTED | DETECTED | DETECTED | CLOSE (DIAGONAL) | PRINTING CANNOT BE STARTED |
| UNDETECTED | DETECTED | UNDETECTED | UNDETECTED | CLOSE (DIAGONAL) | PRINTING CANNOT BE STARTED |
| UNDETECTED | DETECTED | UNDETECTED | DETECTED | CLOSE | PRINTING CANNOT BE STARTED |
| UNDETECTED | DETECTED | DETECTED | DETECTED | CLOSE (DIAGONAL) | PRINTING CANNOT BE STARTED |
| DETECTED | DETECTED | UNDETECTED | UNDETECTED | CLOSE (DIAGONAL) | PRINTING CANNOT BE STARTED |
| DETECTED | DETECTED | UNDETECTED | DETECTED | CLOSE (DIAGONAL) | PRINTING CANNOT BE STARTED |
| DETECTED | DETECTED | DETECTED | DETECTED | JOINED | PRINTING CAN BE STARTED |

FIG.18

| SENSOR 69 STATE | STACKER OPERATION STATE | SENSOR 70 STATE | STACKER STATE | PRINTER PRINTING OPERATION |
|---|---|---|---|---|
| DETECTED | OPERABLE | DETECTED | JOINED | PRINTING CAN BE STARTED |
| DETECTED | NOT OPERABLE | DETECTED | JOINED | PRINTING CANNOT BE STARTED |
| DETECTED | OPERABLE OR NOT OPERABLE | UNDETECTED | UNCLEAR | PRINTING CANNOT BE STARTED |
| UNDETECTED | | UNDETECTED | SEPARATED | PRINTING CAN BE STARTED |
| UNDETECTED | | DETECTED | CLOSE | PRINTING CANNOT BE STARTED |

FIG.27

ARTICLE DELIVERY SYSTEM

BACKGROUND OF THE INVENTION

1. Field of the Invention

The present invention relates to an article delivery system that is suitably used for a printing apparatus.

2. Description of the Related Art

Japanese Patent Laid-Open No. 2006-315867 discloses a printing apparatus that comprises a discharged sheet stacker and a discharged rolled-sheet stacker. The discharged sheet stacker is contractible, and the discharged rolled-sheet stacker can be attached to or removed from the discharged sheet stacker when in the contracted state. In Japanese Patent Laid-Open No. 2006-315867, when using rolled sheet having a habit of curling, sheets are discharged to the discharged rolled-sheet stacker, and in other cases, sheets are discharged to the discharged sheet stacker.

As disclosed in Japanese Patent Laid-Open No. 2006-315867, when a printing apparatus has a stacker, the size of the required stacker becomes larger the larger the sheets become, and the operation for attaching or removing the stacker requires additional work.

Therefore, it is feasible to provide a stacker that is separate from the printing apparatus, and when necessary to connect the stacker to the printing apparatus. However, in the case that the connection is not perfect, there is a high possibility that sheets will become jammed.

SUMMARY OF THE INVENTION

The present invention makes suitable delivery of articles possible in a system that delivers articles from a supply device to a receiving device.

According to a first aspect of the present invention, there is provided a delivery system comprising: a supply device that has a supply port for supplying an article; a receiving device that has a receiving port being able to receive the article that is supplied from the supply port; and a detection unit that is capable of detecting: a first state in which the supply device and the receiving device are joined by the supply port engaging with the receiving port; a second state in which the supply device and the receiving device are close together and there is a space between the supply port and the receiving port; and a third state in which the supply device and the receiving device are separated and the space between the device is wider than in the second state.

According to a second aspect of the present invention, there is provided a delivery system comprising: a supply device having a supply port for supplying an article; a receiving device having a receiving port that is able to receive the article that is supplied from the supply port; and a storage unit that is arranged between the supply device and the receiving device and stores sheets that are supplied from the supply port; wherein the system is capable of taking a first state in which the supply port and the receiving port engage, and the supply device and the receiving device are joined, and a second state in which the supply device and the receiving device are separated; and sheets that are supplied from the supply port are delivered by way of the receiving port in the first state, and drop into and are stored in the storage unit without passing through the receiving port in the second state.

According to a third aspect of the present invention, there is provided a delivery system comprising: a supply device having a supply port for supplying an article; and a receiving device having a receiving port that is able to receive the article that is supplied from the supply port; wherein the system is capable of taking a first state in which the supply port and the receiving port engage, and the supply device and the receiving device are joined, and a second state in which the supply device and the receiving device are separated; and the supply device and the receiving device are electrically connected by a cable, with that cable connection being maintained in both the first state and the second state, and electric power is supplied by way of the cable from the supply device to the receiving device, or from the receiving device to the supply device.

Further features of the present invention will become apparent from the following description of exemplary embodiments (with reference to the attached drawings).

BRIEF DESCRIPTION OF THE DRAWINGS

FIG. 15 is a table illustrating the relationship between the detection results by the respective sensors and the printing operation;

FIG. 18 is a table illustrating the relationship between the detection results by the respective sensors and the printing operation;

FIG. 27 is a table illustrating the relationship between the detection results by the respective sensors and the printing operation.

DESCRIPTION OF THE EMBODIMENTS

Figure 1:
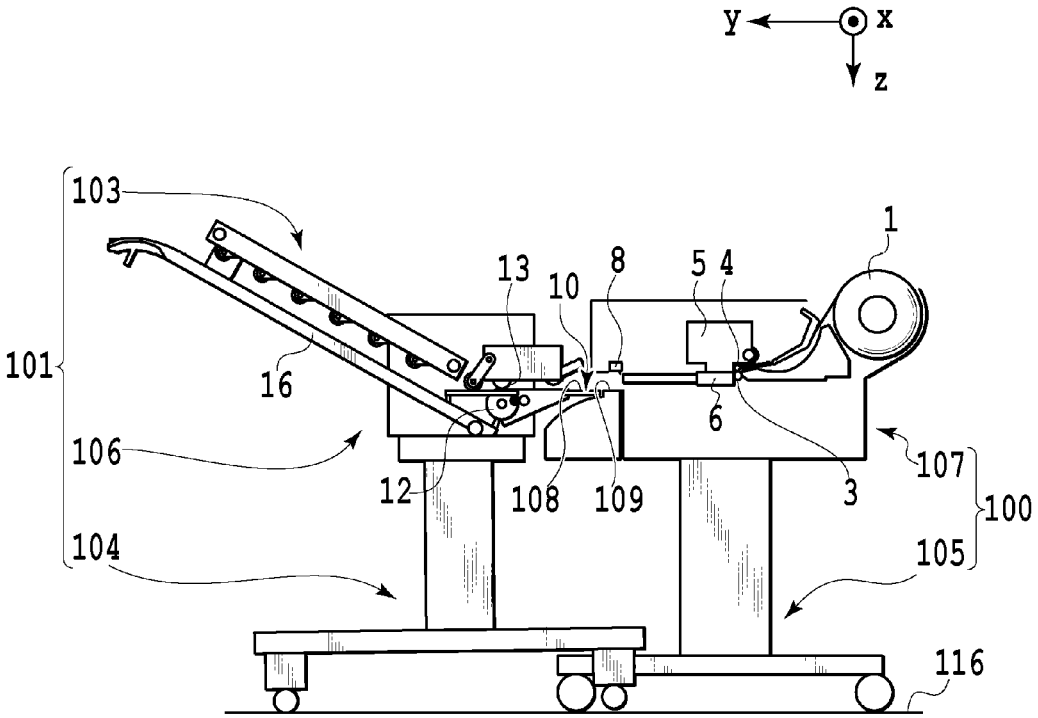
FIG. 1 is a cross-sectional view illustrating the internal construction of a stacker and printing apparatus.

FIG. 1 is a cross-sectional view illustrating the internal construction of a sheet-stacking device (hereafter, referred to as a "stacker") 101 as a receiving device, and of a printing apparatus (hereafter, referred to as a "printer") 100 as a supply device. An article delivery system for delivering sheets as articles comprises the printer 100 and the stacker 101.

In this example, the printer 100 is an ink-jet printer, however, the printer could also be a different type of printer such as an electro-photographic printer. The printer 100 includes a printer unit 107 and a stand unit 105. The printer unit 107 is supported by the stand unit 105. The printer unit 107 comprises: a conveyance roller 3, a pinch roller 4, a printing head 5, a platen 6, a cutter 8, and a printer opening port 109 (a supply port or a discharge port). Moreover, the printer 100 comprises an operation unit (not illustrated in the figure). The operation unit is provided with various switches and the like. A user uses the various switches that are provided on the operation unit, and inputs various commands to the printer 100 such as a size specification for the sheets 1, or a command to switch between online and offline.

The stacker 101 includes a stacker unit 106, a tray unit 103, and a stand unit 104. The stacker unit 106 and the tray unit 103 are supported by the stand unit 104. The stacker unit 106 comprises a stacker opening port 108 (a receiving port), a conveyance roller 12, and a pinch roller 13. The tray unit 103 comprises a tray (mounting unit) 16 that is constructed so that the sheets 1 can be mounted. The stacker opening port 108 is open so as to face in a direction that faces the opening direction of the printer opening port 109. When the printer 100 and stacker 101 are in the joined state, a joint 10 is formed by the printer opening port 109 and the stacker opening port 108.

A rolled sheet that is maintained in a rolled shape is set in the printer unit 107. In the printer 100, the tip end of a sheet is pulled from the rolled sheet, and the sheet 1 that is pulled out is held between the conveyance roller 3 and the pinch roller 4 and conveyed in the conveyance direction (y direction in the figure) by the rotation of the conveyance roller 3 and the rotation of the pinch roller 4 that follows the conveyance roller 3. An image is printed on the sheet 1 by discharging ink downward in the gravity direction (z direction in the figure) from a discharge opening (not illustrated in the figure) of the printing head 5 onto the sheet 1 that was conveyed between the printing head 5 and the platen 6. Suction holes (not illustrated in the figure) are formed in the surface of the platen 6 that faces the printing head 5, and the sheet 1 is made to adhere to the platen 6 by operating a suction fan (not illustrated in the figure) and sucking air in from the suction holes, which prevents the sheet 1 from lifting off toward the printing head 5 side.

In the case illustrated in FIG. 1, the printed sheet 1 is conveyed to the downstream side in the y direction by the conveying power by the rotation of the conveyance roller 3 and pinch roller 4, then discharged from the printer opening port 109, and passes the joint 10 to move from the stacker opening port 108 to the inside of the stacker 101. When the sheet 1 reaches a position between the conveyance roller 12 and the pinch roller 13 and is held by these, the sheet 1 is then further conveyed toward the downstream side in the y direction by the rotation of the conveyance roller 12 and the rotation of the pinch roller 13 that follows the rotation of the conveyance roller 12. The sheet 1 is then conveyed toward the tray unit 103 that is located further on the downstream side in the y direction than these rollers. When printing of an image on the sheet 1 is finished, the sheet 1 is cut to a specified length by the cutter 8. The cut sheet 1 is then conveyed to the downstream side in the y direction by the rotation of the conveyance roller 12 and pinch roller 13, and placed in the tray 16. In this example, a rolled sheet was used as the sheet, however, it is also possible to use a cut sheet that is cut beforehand to a specified size.

Figure 2:
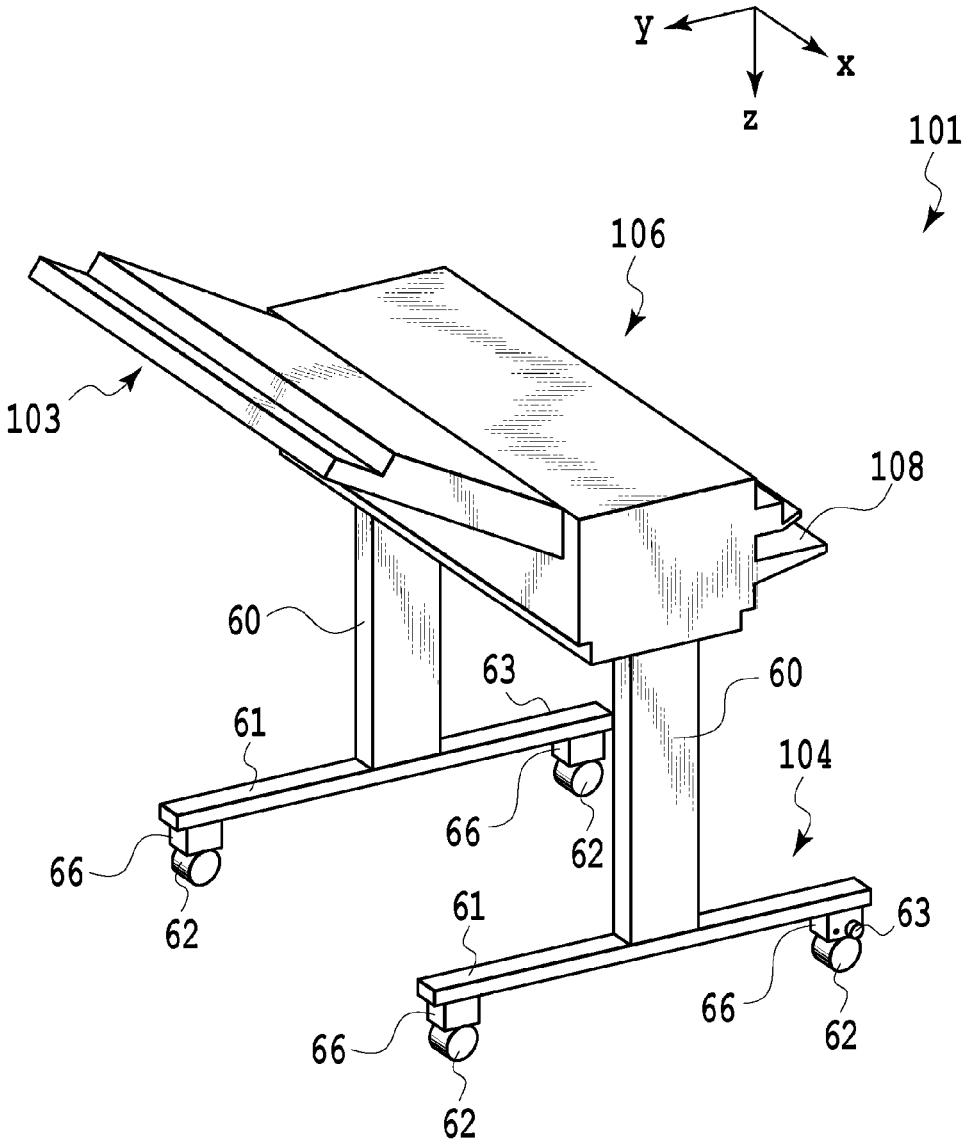
FIG. 2 is a perspective view illustrating the external appearance of the stacker.

FIG. 2 is a perspective view illustrating the external appearance of the stacker 101. The stand unit 104 comprises legs 60, feet 61, casters 62 and rollers (engaging sections) 63. In the state illustrated in FIG. 2, the legs 60 extend in the z direction, and are provided on both ends in the x direction that crosses the y direction. In the following, "right" and "left" respectively indicate the "right" side portion and the "left" side portion on both ends in the x direction as seen from the upstream side to the downstream side in the y direction. The size of the legs 60 is set so that when the printer 100 and the stacker 101 are joined, the position of the printer opening port 109 and the position of the stacker opening port 108 are at the same height. The feet 61 extending in the y direction are provided on the bottom surfaces (surfaces that face downward in the z direction) of the legs 60, respectively. The length of the feet 61 in the y direction is set to a length so as to be able to maintain stable movement of the stacker 101. Support members 66 are located on both ends of the bottom surfaces of the feet 61 in the y direction, and the casters 62 are attached to the bottom surfaces of the support members 66 so as to be able to rotate. In this example, the four casters 62 come in contact with a floor surface 116 (FIG. 1). The stacker 101 is able to move over the floor surface according to an operation by a user. In this way, in a state in which the printer 100 is not joined, all of the casters 62 come in contact with the floor surface, and receive the effect of the state of the floor surface (for example, unevenness), and the position of the stacker 101, for example the position in the up-down z direction, may fluctuate.

Moreover, the rollers 63 are attached to the outer surfaces of the support members 66 on the upstream side in the y direction (surfaces on the other side of the surfaces of the left and right support members 66 that face each other) so as to be able to rotate. The rollers 63 are located substantially directly underneath the stacker opening port 108. The rollers 63 are located higher in the z direction than the position of the casters 62 and do not come in contact with the floor surface, so the rollers 63 are not affected by the state of the floor surface.

Figure 3:
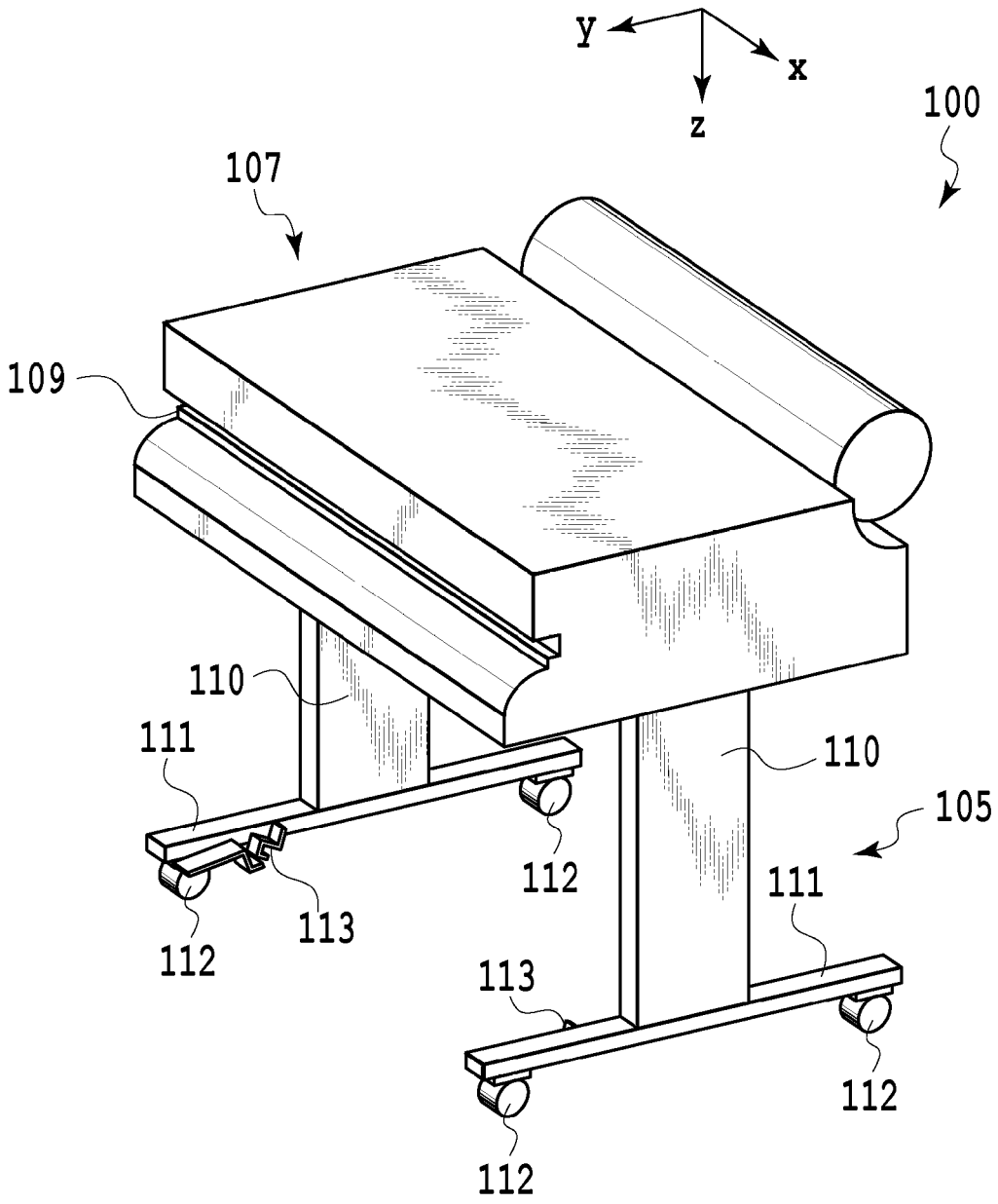
FIG. 3 is a perspective view illustrating the external appearance of the printing apparatus.

FIG. 3 is a perspective view illustrating the external appearance of the printer 100. The stand unit 105 comprises legs 110, feet 111, casters 112 and roller receptacles (engaging sections) 113. The legs 110 are located on the left and right of the printer unit 107, and the height (length in the z direction) of the legs 110 is set to a height that takes into consideration the operability of the printer unit 107. The basic construction of the feet 111 and casters 112 is the same as that of the feet 61 and casters 62, so explanations thereof will be omitted. The printer 100 is able to move over the floor surface according to an operation by a user. In the printer 100, the four casters 112 come in contact with the floor surface regardless of whether or not the printer 100 is joined to the stacker 101, so the position of the printer 100 may fluctuate according to the state of the floor surface.

Moreover, the roller receptacles 113 are provided on the inside surfaces (surfaces of the left and right feet 111 that face each other) on the downstream side in the y direction of the feet 111. The roller receptacles 113 are provided substantially directly underneath the printer opening port 109. The roller receptacles 113 are provided higher in the z direction than the position of the casters 112 and do not come in contact with the floor surface, so they are not affected by the state of the floor surface. The roller receptacles 113 are members for receiving the rollers 63 that are attached to the stacker 101, when the stacker 101 and the printer 100 are joined. Stoppers (not illustrated in the figures) are provided on the casters of the printer 100 and stacker 101, and are able to secure the printer 100 and stacker 101 at desired positions.

Figure 4:
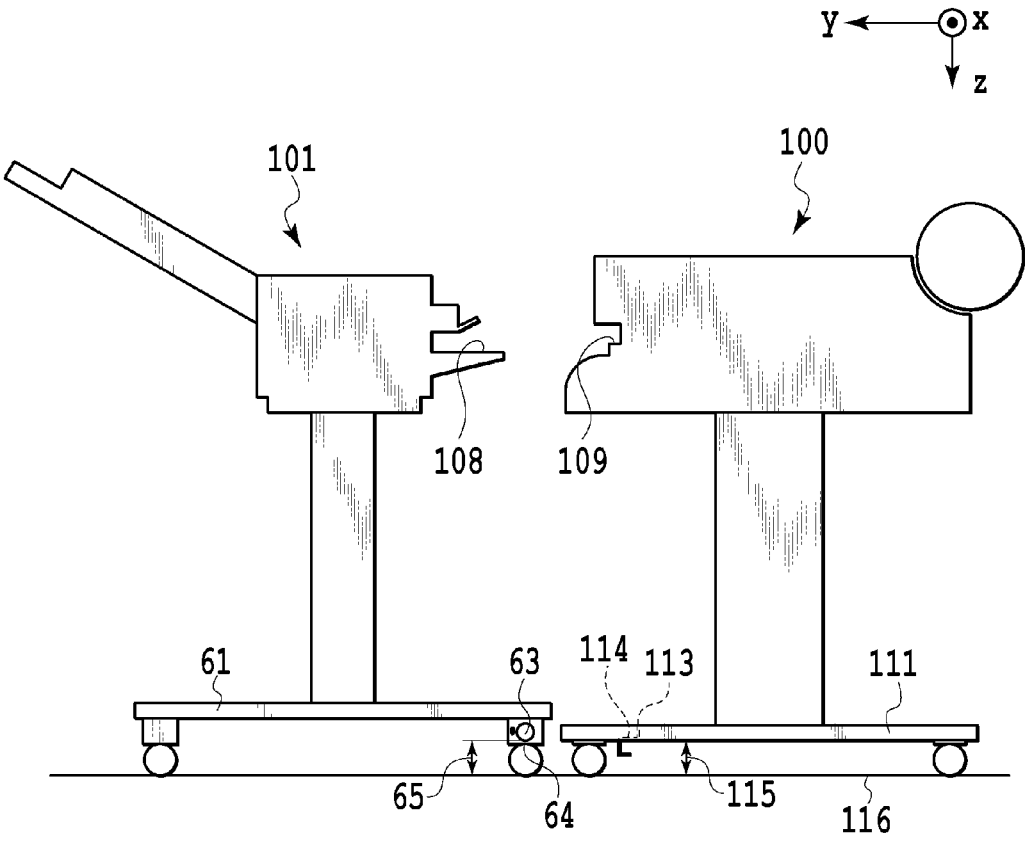
FIG. 4 is a side view illustrating the stacker and the printing apparatus.

FIG. 4 is a side view illustrating the stacker 101 and the printer 100, and illustrates the state in which the stacker 101 and the printer 100 are separated (hereafter, this state will also be referred to as the "third state"). A point of the rollers 63 that is closest to the floor surface 116 is taken to be the lowest point 64 of the rollers, and the distance from the lowest point 64 to the floor surface 116 is taken to be the roller height 65. Moreover, the distance from the top surfaces (surfaces that face upward in the z direction) 114 of the roller receptacles 113 to the floor surface 116 is taken to be the receptacle height 115. In the third state, a relationship is established in which the roller height 65<receptacle height 115. In other words, in the third state, the heights of the rollers 63 and the receptacles 113 are set so that the relationship in which the roller height 65<receptacle height 115 is established.

In order to go from the state in which the stacker 101 and the printer 100 are separated to the joined state, a user faces together the printer opening port 109 (supply port/discharge port) and the stacker opening port 108 (receiving port), and moves any one or both in a direction toward the other. In this way, the printer 100 and the stacker 101 can be joined. Next, the joined state in which the stacker 101 and the printer 100 are joined (hereafter, also referred to as the "first state") will be explained.

Figure 5:
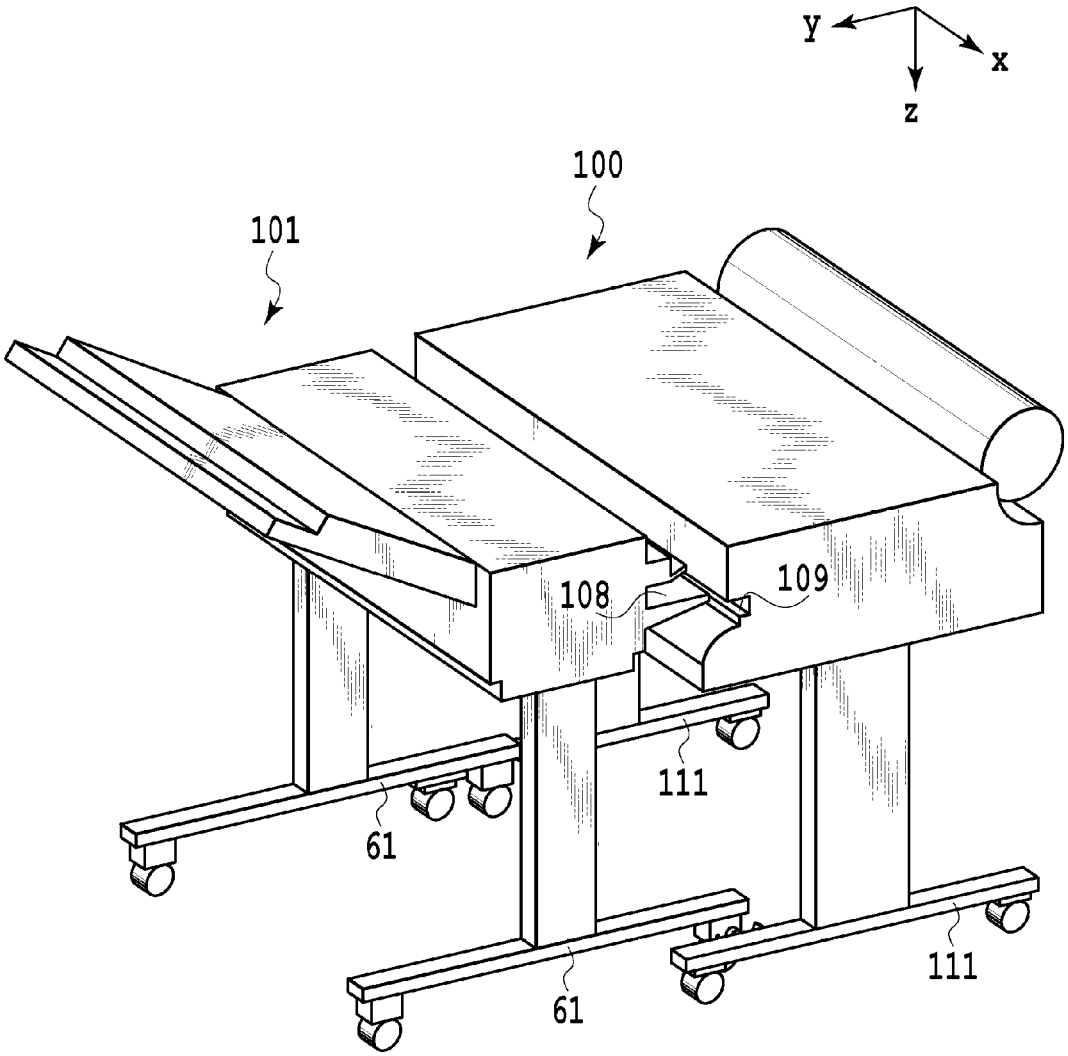
FIG. 5 is a perspective view for explaining a first state of the stacker and the printing apparatus.
Figure 6:
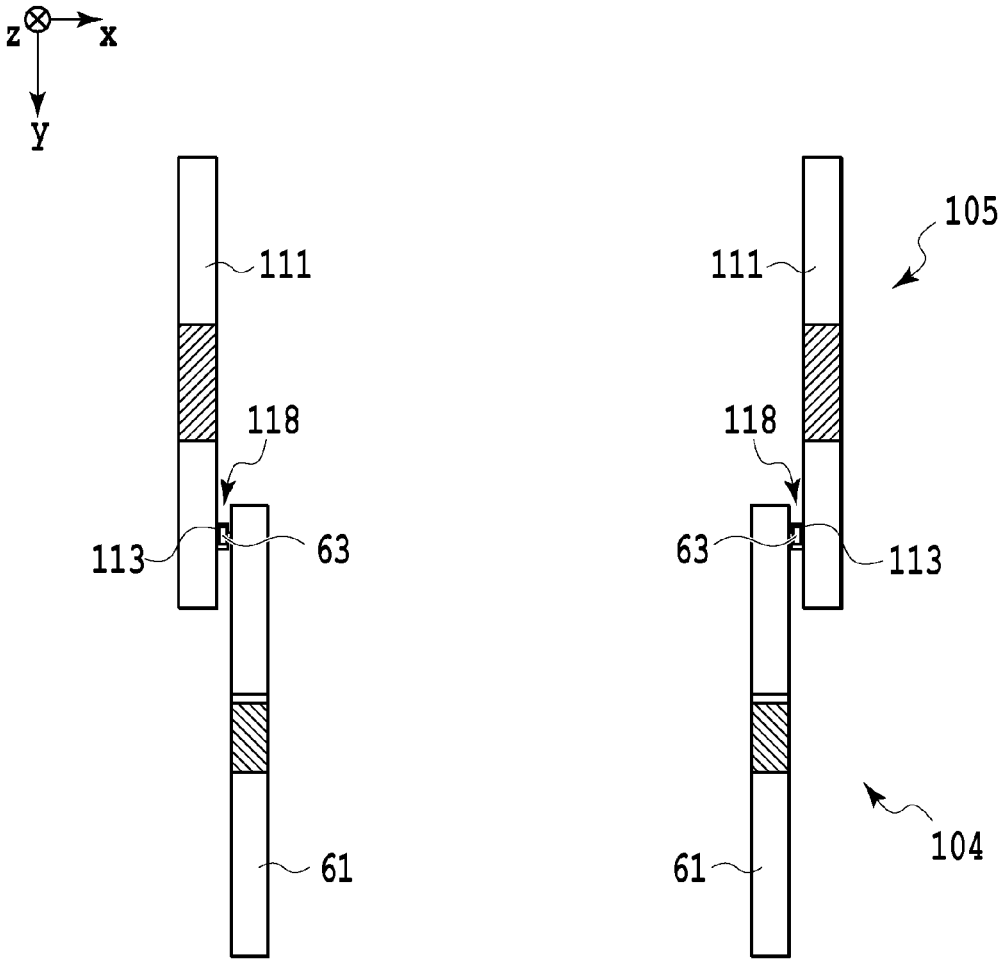
FIG. 6 is a top view for explaining the first state of the stacker and the printing apparatus.
Figure 7:
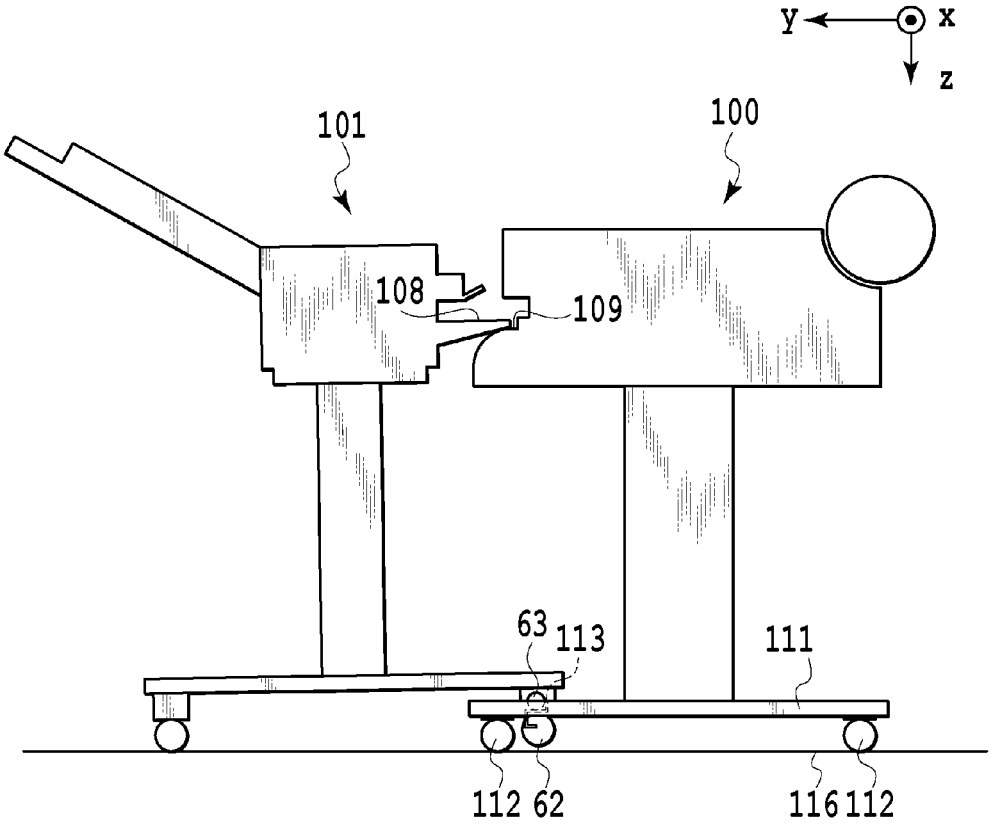
FIG. 7 is a side view for explaining the first state of the stacker and the printing apparatus.

FIGS. 5 to 7 are drawings for explaining the first state of the stacker 101 and the printer 100, where FIG. 5 is a perspective view, FIG. 6 is a top view illustrating the feet 61 and the feet 111 as seen from above looking downward in the z direction, and FIG. 7 is a side view. In the first state illustrated in FIGS. 5 to 7, it is possible to properly deliver a sheet 1 from the printer opening port 109 to the stacker opening port 108. The "first state" is taken to be the state in which the printer opening port 109 and the stacker opening port 108 are joined.

As illustrated in FIGS. 5 and 6, the space between the left and right feet 61 of the stacker 101 is narrower than the space between the left and right feet 111 of the printer 100, so that the part of the feet 61 can fit between the left and right feet 111. There is a foot space 118 that is provided between the feet 111 and the feet 61 nearby, and in this foot space 118, the rollers 63 and the roller receptacles 113 are joined.

As illustrated in FIG. 7, in the state in which the rollers 63 have ridden up into the roller receptacles 113, the stacker 101 and the printer 100 are joined. Therefore, the position of the stacker opening port 108 is set so that in the state in which the rollers 63 have ridden up into the roller receptacles 113, the height is the same as the height of the position of the printer opening port 109. As was explained with reference to FIG. 4, in the third state the relationship is established in which the roller height 65<receptacle height 115, so as illustrated in FIG. 7, by the rollers 63 riding up into the roller receptacles 113, the casters 62 on the upstream side in the y direction become separated from the floor surface 116. Therefore, the casters 62 on the upstream side in the y direction are not affected by the state of the floor surface 116. In other words, in the first state, the left and right casters 62 on the downstream side in the y direction, the left and right casters 112 on the downstream side in the y direction, and the left and right casters 112 on the upstream side in the y direction are in contact with the floor surface 116.

Figure 8:
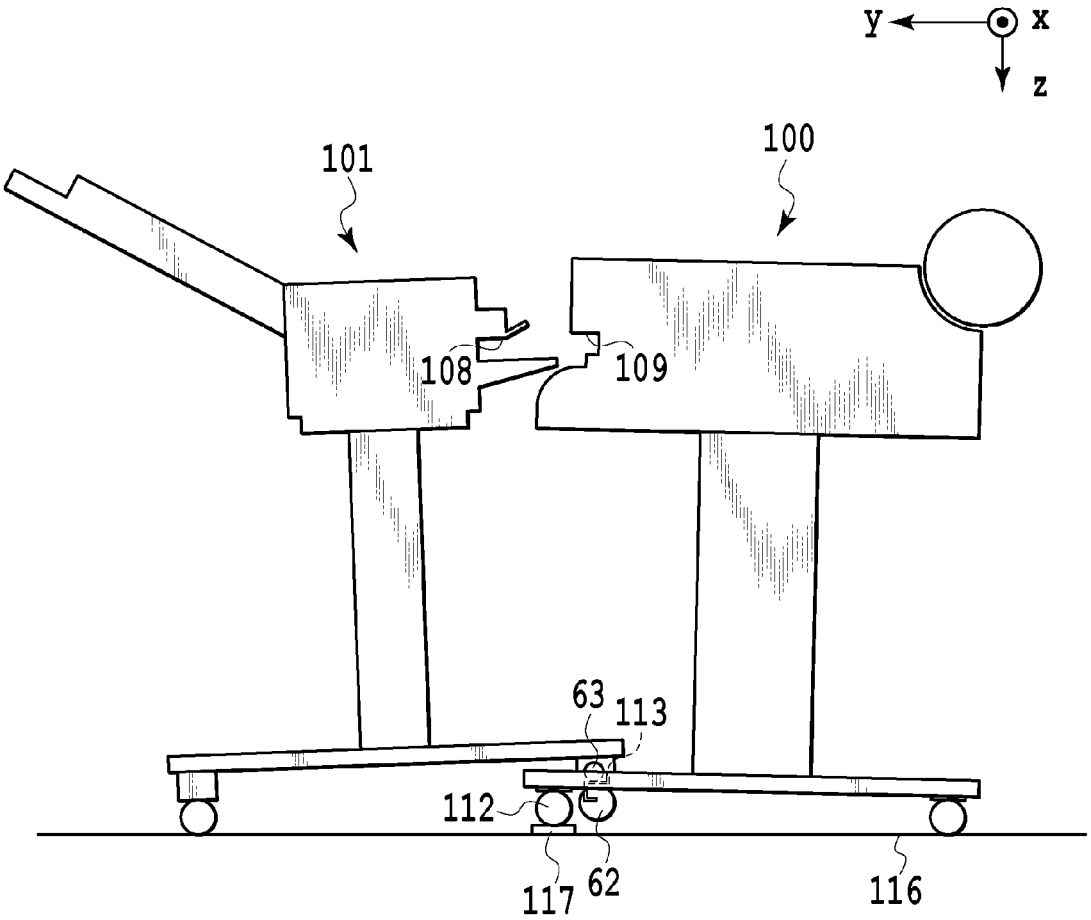
FIG. 8 is a side view for explaining the first state of the stacker and the printing apparatus.

Here, there is a convex section 117 on the floor surface 116, and the case in which the casters 112 on the downstream side in the y direction ride up on this convex section 117 will be explained with reference to FIG. 8. FIG. 8 is a side view for explaining the first state of the stacker and printer, and is a side view illustrating the state in which the casters 112 on the downstream side in the y direction have ridden up onto the convex section 117. The casters 112 on the downstream side in the y direction have ridden up on the convex section 117, so the height of the casters 62 from the floor surface 116 becomes higher by the amount of the height of the convex section 117.

As described above, the printer 100 and the stacker 101 are joined by the rollers 63 of the stacker 101 riding up into the roller receptacles 113 of the printer 100. Moreover, the roller receptacles 113 are located substantially directly below the printer opening port 109, and the rollers 63 are located substantially directly underneath the stacker opening port 108. Therefore, even when the floor surface 116 is not a flat surface (for example, when there is a convex section as illustrated in FIG. 8), the positional relationship between the printer opening port 109 and the stacker opening port 108 does not substantially change, and the printer opening port 109 and the stacker opening port 108 are at substantially the same height. As a result, even when the floor surface 116 is not a flat surface, it is possible to properly deliver a sheet 1.

In the above, an example was explained for a case in which there was a convex section 117 on the floor surface 116, however, in a case in which there is a concave section on the floor surface as well, the positional relationship between the printer opening port 109 and the stacker opening port 108 does not fluctuate, so it is possible to properly deliver a sheet 1. Moreover, in the above, construction in which the stacker 101 rides up onto the printer 100 was explained, however, it is possible to obtain the same effect even in the case of construction in which the printer 100 rides up onto the stacker 101.

When using paper sheets in the printer 100, many kinds of sheets are used. For example, in the case of using sheet such as glossy paper in a printer 100, when sheets are discharged from the printer and stacked in the stacker 101, sheets may be damaged, or ink may be transferred due to sheets coming into contact with each other. Therefore, depending on the type of sheets, it may not be desirable to stack the sheets in the stacker 101. Therefore, depending on the type of sheets, the discharge destination from the printer 100 (sheet discharge method) is switched. In other words, when using sheets for which the effect (damage, ink transfer, and the like) due to stacking is comparatively small, the sheets are discharged to the stacker 101. On the other hand, in the case of using sheets for which the effect due to stacking is comparatively large, the sheets are discharged so as to drop into a basket 123 (storage container) to be described later.

Figure 9:
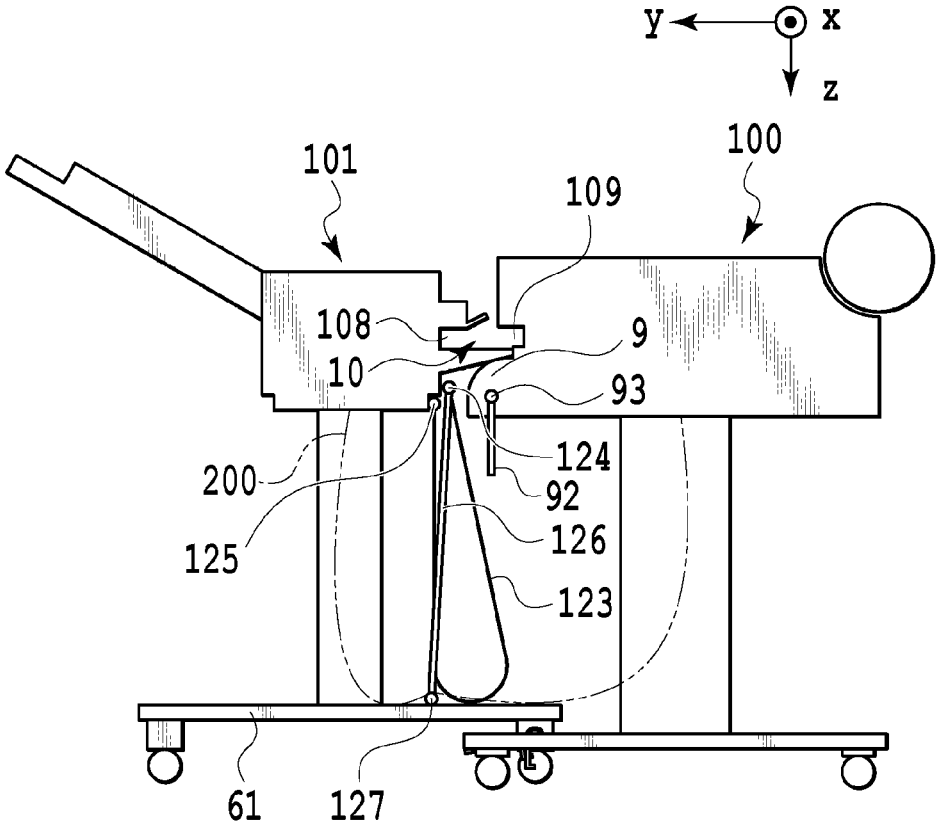
FIG. 9 is a side view illustrating a state in which a basket is stored.
Figure 10:
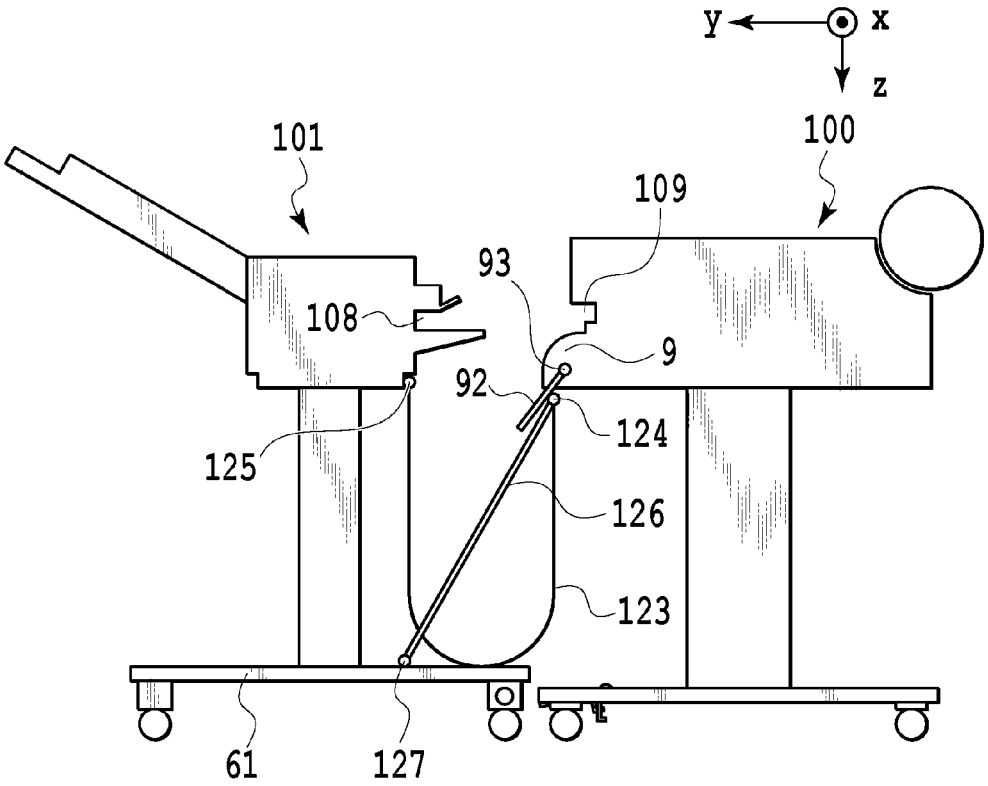
FIG. 10 is a side view illustrating a state in which the basket is released.

FIG. 9 is a side view illustrating the state in which the stacker 101 and the printer 100 are joined and the basket 123 is stored. FIG. 10 is a side view illustrating the state in which the stacker 101 and the printer 100 are separated and the basket 123 is opened. When using the printer 100, the cable 200 (signal connection) illustrated in FIG. 9 is used to electrically connect the printer 100 and the stacker 101, and the power to both devices is turned ON. After that, by joining or separating the stacker 101 and the printer 100, sheets are discharged to either the stacker 101 or the basket 123. In drawings other than FIG. 9, the cable 200 is omitted in illustration. The cable 200 is a USB cable, a LAN cable or other electrical cable, and physically connects signals. The cable 200 is flexible, and the cable connection can be maintained even when the stacker 101 and the printer 100 are close together or separated. The connection method is not limited to a cable, and it is also possible to electrically connect the devices using a non-contact wireless interface.

As illustrated in FIGS. 9 and 10, the basket 123 is located between the stacker 101 and the printer 100, and is constructed such that when opened, sheets 1 that are dropped can be stored inside the basket 123. Also, the basket 123 is supported by the stacker 101. Here, construction is explained in which the basket 123 is supported by the stacker 101, however, the basket 123 could also be supported by the printer 100. The basket 123 is formed using a flexible belt-shaped material such as cloth or plastic. One end of the belt-shaped material is supported by an upstream rod 124, whereas the other end is supported by a downstream rod 125, and the center forms a loose basket that sags due to its own weight. As illustrated in FIGS. 9 and 10, the upstream rod 124 is located further on the upstream side in the y direction than the downstream rod 125, and the downstream rod 125 is located further on the downstream side in the y direction than the upstream rod 124.

In the stacker 101, the downstream rod 125 that extends in the x direction is attached further downward in the z direction than the position of the stacker opening port 108. The downstream rod 125 is attached to a surface of the stacker 101 that faces the printer 100. A side rod shaft 127 that extends in the x direction is provided at a position substantially directly below the position of the downstream rod 125. The side rod shaft 127 is attached to the feet 61 so as to be able to rotate, and supports side rods 126 that extend upward. Two side rods 126 are used, and one side rod 126 is supported by one end of the side rod shaft 127, and the other side rod 126 is supported by the other end. One end of each of the side rods 126 is supported by the side rod shaft 127, and the other ends of the side rods 126 support the ends of the upstream rod 124, respectively.

In the printer 100, a sheet discharge guide 9 that is inclined downward in the z direction is provided at a position downward in the z direction than the printer opening port 109. The sheet discharge guide 9 has a guide shaft 93 and guide bars 92. The guide bars 92 guide the movement of a sheet 1 from the printer opening port 109 toward the basket 123 when using the basket 123. The guide bars 92 are set to a size so that a sheet 1 can drop down from the printer opening port 109 toward the basket 123 even when the space between the printer 100 and the stacker 101 becomes comparatively wide. The guide bars 92 have the guide bar shaft 93, and are able to rotate centered around the guide bar shaft 93. Plural guide bars 92 are provided along the x direction (width of a sheet 1).

When discharging a sheet 1 from the printer 100 to the stacker 101, the basket 123, as illustrated in FIG. 9, is stored in the space below the conveyance path of the joint 10 that is formed by the printer opening port 109 and the stacker opening port 108. Here, the position illustrated in FIG. 9 where the basket 123 is stored is called the first position. Moreover, the state of using the stacker 101 as illustrated in FIG. 9 is called the stacker mode.

When using the stacker 101, a user faces together the printer opening port 109 and the stacker opening port 108, and moves either one or both toward the other and joins the printer opening port 109 and the stacker opening port 108 to maintain a conveyance path.

When using the basket 123, a user moves any one of or both of the printer 100 and the stacker 101 in a direction away from the other and separates the printer 100 and the stacker 101, to provide a space for the basket 123 to open up between these. The user rotates the side rods 126 in the counterclockwise direction as seen from the front of the figure centered around the side rod shaft 127, and opens the basket 123. The user then rotates the guide bars 92 around the guide bar shaft 93, and places the guide bars 92 onto the upstream rod 124 to reach the state illustrated in FIG. 10. Here, the state illustrated in FIG. 10 in which the basket 123 is opened is called the second position. Moreover, as illustrated in FIG. 10, the state of using the basket 123 is called the basket mode.

Figure 11A:
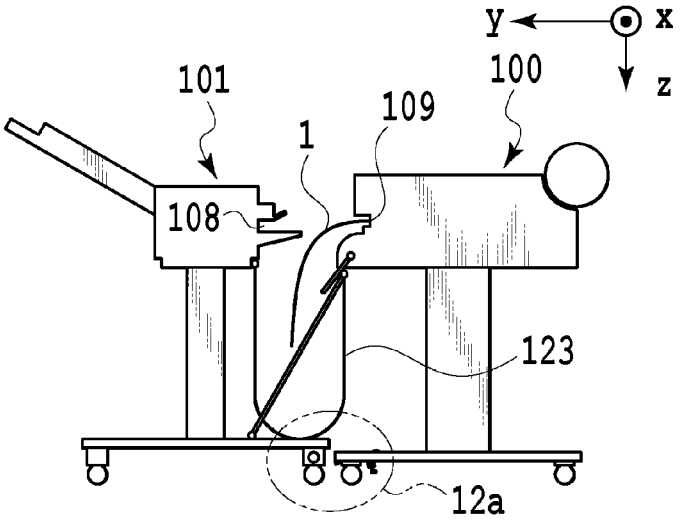
FIGS. 11A to 11C are side views illustrating the positional relationship between the both devices.
Figure 11B:
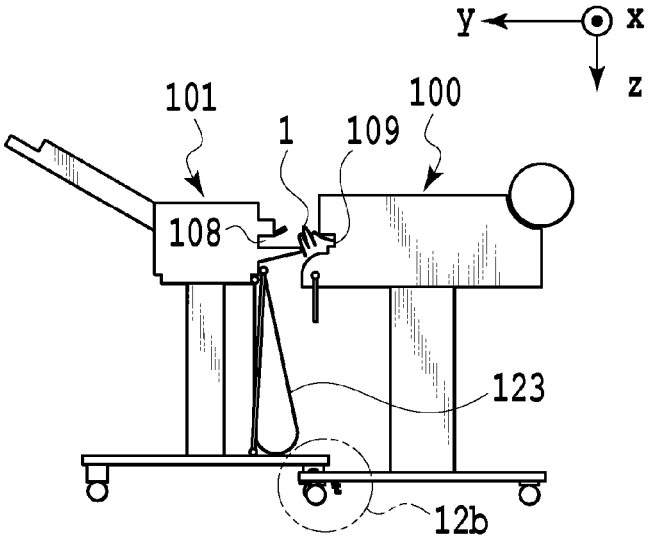
Figure 11C:
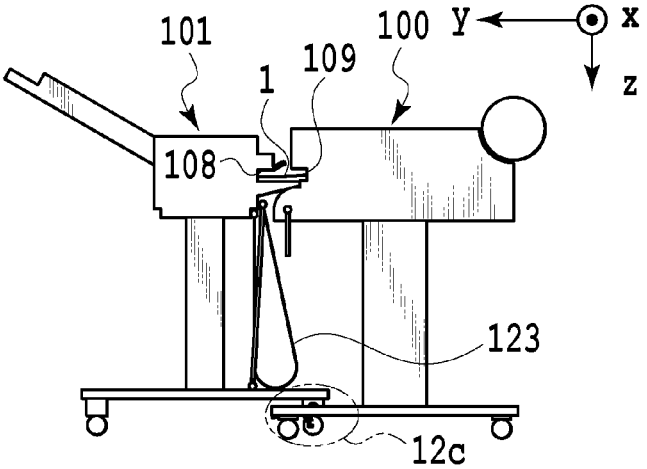

Next, the sheet supply state will be explained for each positional relationship between the printer 100 and the stacker 101. FIGS. 11A to 11C are side views illustrating the positional relationships between the stacker 101 and the printer 100. FIG. 11A illustrates the third state in which the stacker 101 and the printer 100 are separated, and FIG. 11B illustrates the state (hereafter, also referred to as the "second state") in which the stacker 101 and the printer 100 are close together. FIG. 11C illustrates the first state in which the stacker 101 and the printer 100 are joined.

The positional relationships between the printer 100 and the stacker 101 are divided into the three states illustrated in FIGS. 11A to 11C. Here, the "second state" is a state in which there is a gap between the printer opening port 109 and the stacker opening port 108. The "third state" is a state in which a gap between the printer opening port 109 and the stacker opening port 108 is larger than the gap between the printer opening port 109 and the stacker opening port 108 in the second state.

As was described above, when discharging sheet to the basket 123, the operation of separating the printer 100 and the stacker 101, the operation of opening the basket 123 between the printer 100 and the stacker 101, and the operation of placing the guide bars 92 onto the upstream rod 124 are performed by a user. Therefore, when, for example, the basket 123 is not opened up to the position where the guide bars 92 are placed on the upstream rod 124, the user is able to determine that the basket 123 is not opened enough to receive sheets 1. In that case, the user further opens the basket 123 to the position where the guide bars 92 are placed on the upstream rod 124, and with the basket 123 in the desired opened state, the user can place the guide bars 92 onto the upstream rod 124 to set the state in which sheet can be discharged to the basket 123. In other words, as illustrated in FIG. 11A, the printer 100 and the stacker 101 can be set in the separated third state so that a space is provided for the basket 123 to be opened between the printer 100 and the stacker 101 and so that sheet can be discharged to the basket 123.

When discharging sheet to the stacker 101, the operation of joining the printer 100 and the stacker 101 is also performed by the user, however, there is a possibility that when doing this there could be a difference between the user's perceived state and the actual state. In other words, even though the user perceives that the printer 100 and the stacker 101 are in the joined state illustrated in FIG. 11C, there is a possibility that the printer 100 and the stacker 101 are actually not joined but are in the close state as illustrated in FIG. 11B. When the printer opening port 109 and the stacker opening port 108 are not joined as illustrated in FIG. 11B, the leading end of a sheet 1 may get caught in the opening end of the stacker opening port 108 and bend (sheet jam), and so the sheet 1 cannot be properly discharged sometimes.

Therefore, by detecting the positional relationship between the printer 100 and the stacker 101, the printing operation is controlled by determining the state in which sheet can be discharged to the stacker 101 or to the basket 123, or the state in which sheet cannot be discharged to either.

Figure 12A:
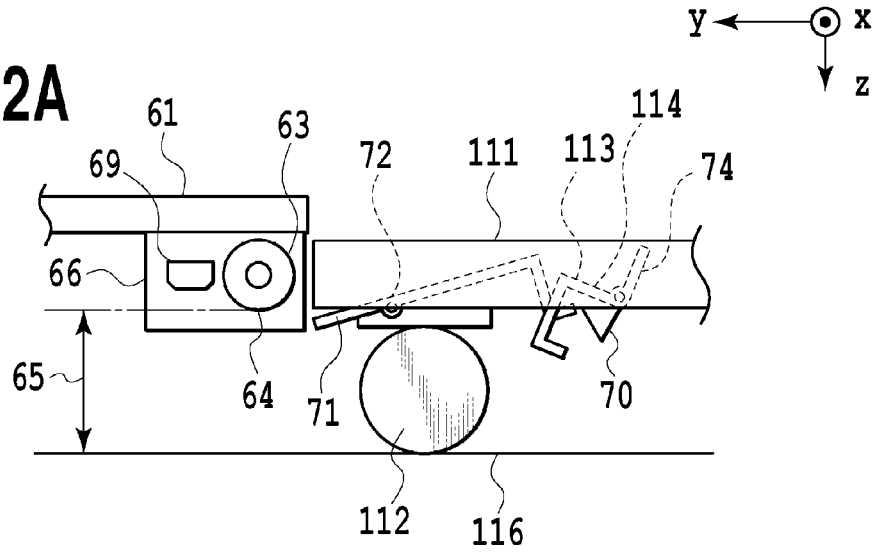
FIGS. 12A to 12C are enlarged side views of FIGS. 11A to 11C, respectively.
Figure 12B:
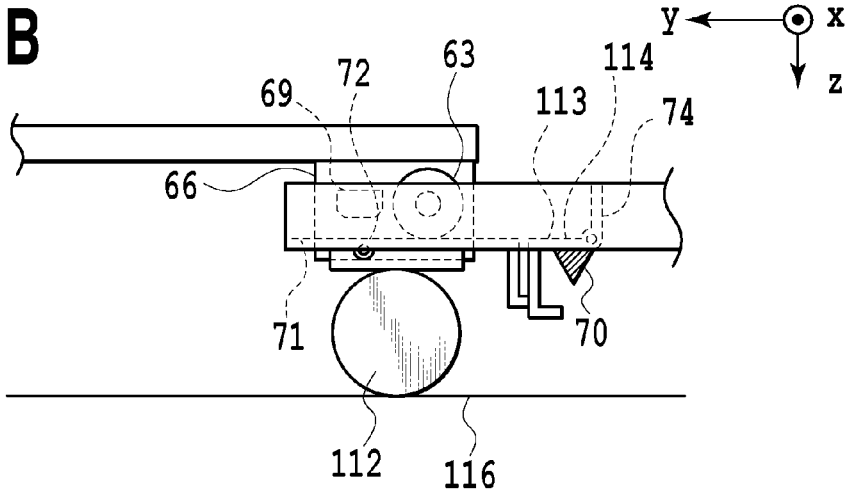
Figure 12C:
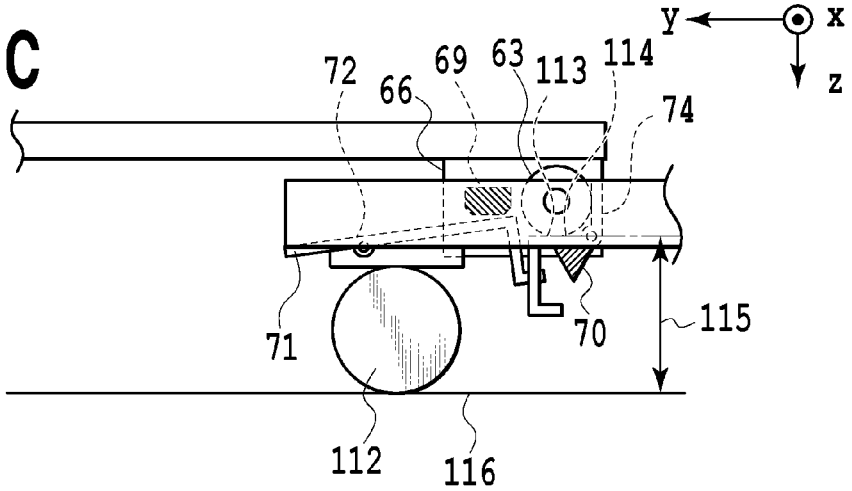

FIG. 12A is an enlarged side view of the dashed line area 12*a* in FIG. 11A, FIG. 12B is an enlarged side view of the dashed line area 12*b* in FIG. 11B, and FIG. 12C is an enlarged side view of the dashed line area 12*c* in FIG. 11C. In FIGS. 12A to 12C, the casters 62 on the upstream side in the y direction are omitted in illustration.

As illustrated in FIGS. 12A to 12C, a sensor 69 (first sensor of a detection unit) is provided on a foot 61 of the stacker 101, and a sensor 70 (second sensor of a detection unit) is provided on a foot 111 of the printer 100. More specifically, the sensor 69 is located on the outer surface of the left support member 66, and the sensor 70 is located on the inner-surface side of the left foot 11. Contact type sensors that output a detection signal when in contact with an object are used for the sensors 69, 70. The sensor 69 detects a roller guide 71 that will be described later, and the sensor 70 detects the roller receptacle 113.

The sensor 70 is located in a position that can come into contact with the surface on the reverse side from the top surface 114 of the roller receptacle 113. A roller guide 71 is provided further on the downstream side in the y direction than the position of the roller receptacle 113 of the foot 111. The roller guide 71 guides the movement of the roller 63 when passing over the top surface thereof. The roller guide 71 has a guide shaft 72 and is able to rotate centered around the guide shaft 72, and is pressed in the counterclockwise direction as seen from the front in the figures by a pressure spring (not illustrated in the figures). In this state, as illustrated in FIG. 12A, the roller guide 71 forms an incline that inclines downward toward the downstream side in the y direction, and in order that the roller 63 can easily ride up onto the roller guide 71, the tip end of the roller guide 71 is located in a position where the roller 63 can be received. The roller receptacle 113 is able to rotate centered around a receptacle shaft 74, and is pressed in the clockwise direction by a pressure spring (not illustrated in the figures). The roller receptacle 113 engages with the roller guide 71 so as to be able to rotate with the rotation of the roller guide 71.

When the printer 100 and the stacker 101 are in the third state illustrated in FIG. 11A, the sensor 69 is not in contact with the roller guide 71 as illustrated in FIG. 12A, so the roller guide 71 is not detected. Moreover, the sensor 70 is not in contact with the roller receptacle 113 as well, so the roller receptacle 113 is not detected. Therefore, in the third state, no detection signal is outputted from either of the sensors.

When the printer 100 and the stacker 101 are brought even closer together from the state illustrated in FIG. 12A, the roller 63 rides up on the roller guide 71, and as a result, the roller guide 71 rotates in the clockwise direction as seen from the front in the figure, and together with this, the roller receptacle 113 rotates in the counterclockwise direction. When this happens, the state becomes as illustrated in FIG. 12B. When the printer 100 and the stacker 101 are in the second state illustrated in FIG. 11B, the roller 63 is positioned on the roller guide 71 as illustrated in FIG. 12B. In this case, the roller receptacle 113 is in contact with the sensor 70, so the sensor 70 outputs a detection signal. On the other hand, the roller guide 71 is not in contact with the sensor 69, so a detection signal is not outputted from the sensor 69.

When the printer 100 and the stacker 101 are brought even closer together from the state illustrated in FIG. 12B, the roller 63 is guided by the roller guide 71 and moves further toward the upstream side in the y direction and reaches the roller receptacle 113. When the roller 63 moves from the roller guide 71 into the roller receptacle 113, the roller guide 71 rotates in the counterclockwise direction as seen from the front in the figures, and the state becomes as illustrated in FIG. 12C. When the printer 100 and the stacker 101 are in the first state illustrated in FIG. 11C, the sensor 69 is in contact with the roller guide 71 as illustrated in FIG. 12C, and the sensor 70 is in contact with the roller receptacle 113. Therefore, when in the first state, detection signals are outputted from both sensors 69, 70. By detecting the engaged state between the roller 63 and the roller receptacle 113 in this way, the positional relationship between the stacker 101 and the printer 100 is determined.

As was explained with reference to FIG. 11B, when the printer 100 and the stacker 101 are close together, it may not be possible to properly deliver a sheet 1 from the printer 100 to the stacker 101. Therefore, when the printer 100 and the stacker 101 are not in either the third state or the first state, in other words, when in the second state, the printer 100 is controlled so that printing is not performed. As a result, a sheet jam (see FIG. 11B) that may accidentally occur between the supply opening and the receiving opening as in the second state when printed sheets are discharged is prevented.

Moreover, when a detection signal is outputted from the sensor 69 and no detection signal is outputted from the sensor 70, the positional relationship between the printer 100 and the stacker 101 is unclear. Even in this state in which the positional relationship is unclear (hereafter, also referred to as the "fourth state"), the printer 100 is controlled so that printing is not performed. When the sensor 69 comes into contact with an object other than the roller guide 71 and the sensor 69 outputs a detection signal, or when no detection signal is outputted from the sensor 70 even though the sensor 70 is in contact with the roller receptacle 113, the user is able to check the state of the sensors. The user can cause the sensors to display the desired function by removing the object that the sensor 69 is detecting in the former case, or by restoring the function of the sensor 70 in the latter case.

Figure 13:
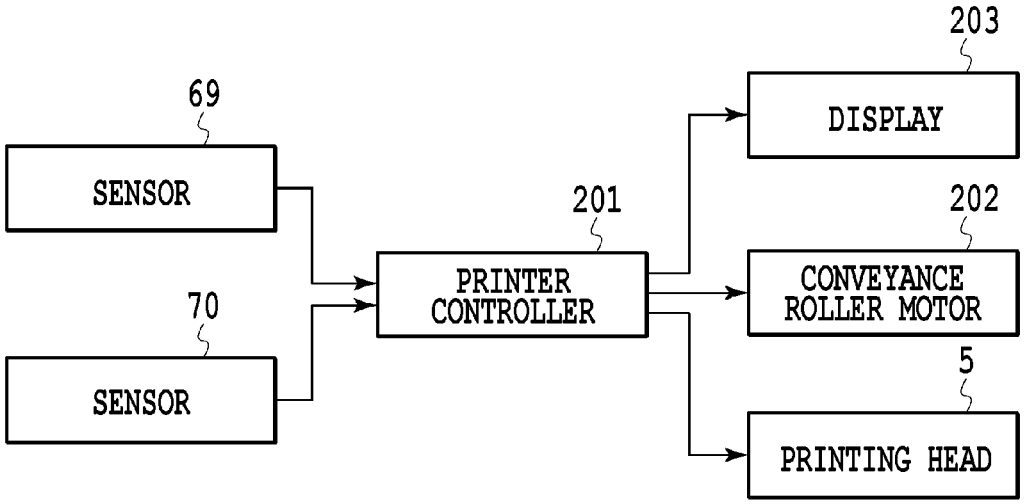
FIG. 13 is a block diagram illustrating the control configuration in a first embodiment.

FIG. 13 is a block diagram illustrating the construction of the overall control system. As was explained with reference to FIG. 9, when using the printer 100, the printer 100 and the stacker 101 are electrically connected by the cable 200. As a result, the sensor 69 of the stacker 101 and a printer controller 201 of the printer 100 are connected. The printer controller 201 is connected with the sensor 69, the sensor 70, the conveyance roller motor 202, the display 203, and the printing head 5. The printer controller 201 is a controller for controlling all of the operations of the printer 100, and controls the printing operation by acquiring detection results from the sensors 69, 70, and controlling the conveyance roller motor 202 and the printing head 5 according to the detection results. The conveyance roller motor 202 is a motor for driving the conveyance roller 3 of the printer 100. The printer controller 201 acquires the detection results from the sensors 69, 70 and displays position information between the printer 100 and the stacker 101 on the display 203 according to the detection results. Such construction will be explained in detail with reference to FIG. 14. The display 203 functions as a notification device for notifying the user of various kinds of information. The case of using the display as a notification device will be explained, however, it is also possible to use an audio output device such as a speaker as a notification device.

Figure 14:
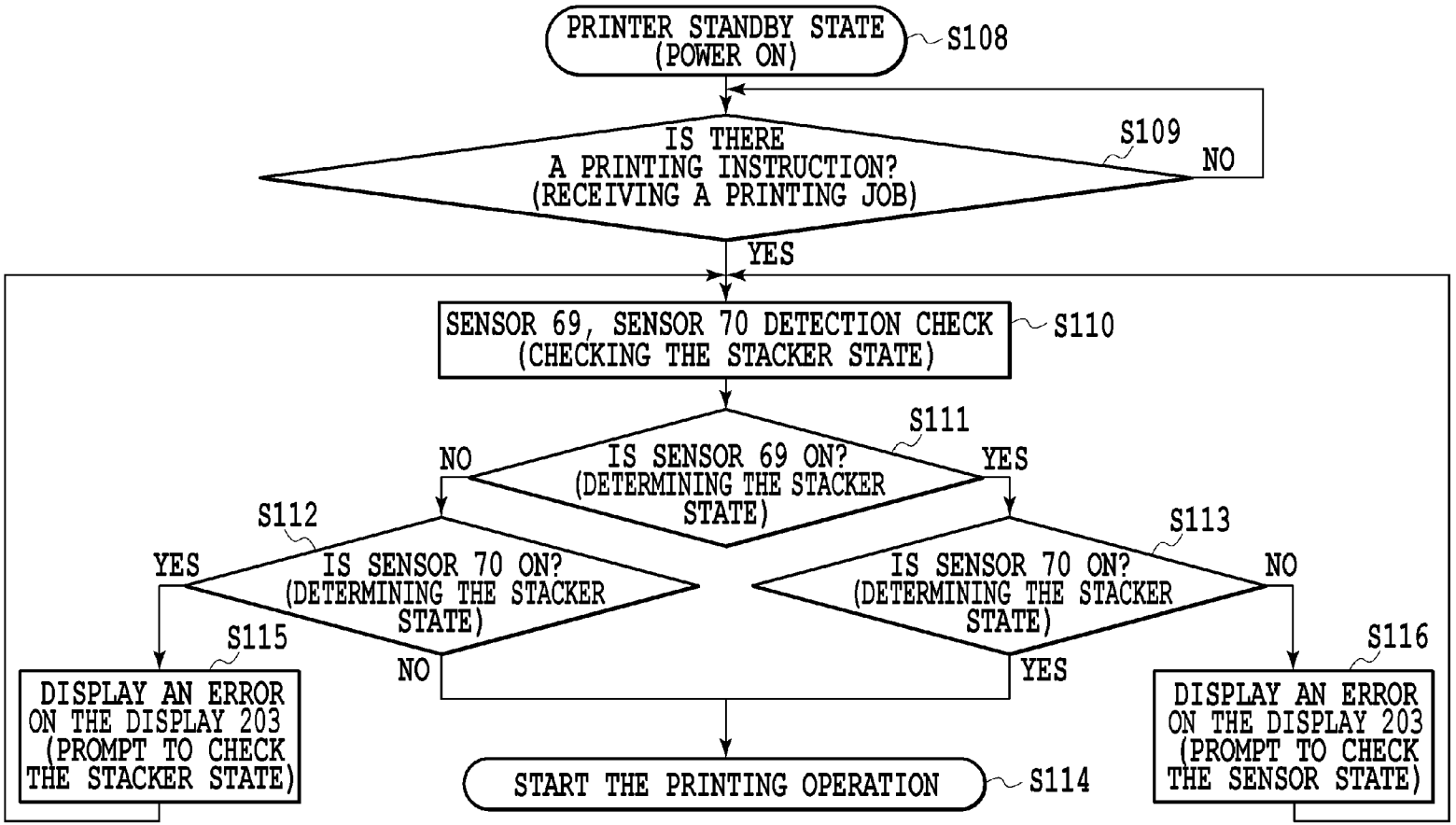
FIG. 14 is a flowchart illustrating processing up to the start of a printing operation in the first embodiment.

FIG. 14 is a flowchart illustrating the process up to the start of the printing operation. FIG. 15 is a table illustrating the relationship between the detection results from the sensors 69, 70 and the printing operation. When the user connects the printer 100 and the stacker 101 using the cable 200, and turns the power ON to the printer 100 and the stacker 101, the printer 100, as illustrated in FIG. 14, is in the standby state and waits for input of a printing job (S108). The printer controller 201 determines whether or not the printing job has been received (S109). When the printing job has not been received (S109: NO), the printer controller 201 repeats the checking process until the printing job has been received (S109). When the printing job has been received (S109: YES), the printer controller 201 checks the detection status of the sensors 69, 70 (S110). The printer controller 201 determines whether or not a detection signal has been inputted from the sensor 69 (S111), and determines whether or not a detection signal has been inputted from the sensor 70 (S112, S113).

When the detection signals have been inputted from both of the sensors 69. 70 (S111: YES, and S113: YES), the printer 100 and the stacker 101 are joined, that is, in the first state as illustrated in FIG. 15, so the printer controller 201 starts the printing operation (S114). When the detection signals are not inputted from either of the sensors 69, 70 (S111: NO, and S112: NO), the printer 100 and the stacker 101 are separated, that is, in the third state as illustrated in FIG. 15, so the printer controller 201 starts the printing operation (S114).

When the detection signal is not inputted from the sensor 69, but the detection signal is inputted from the sensor 70 (S111: NO, and S112: YES), the printer 100 and the stacker 101 are separated, that is, in the second state as illustrated in FIG. 15. In this case, the printer controller 201 does not start the printing operation, but displays an error on the display 203 (S115). As a result, the user is prompted to check the positional relationship between the printer 100 and the stacker 101, and move the devices into the first state or the third state. Then, the printer controller 201 checks the detection status of the sensors 69, 70 again (S110).

When the detection signal is inputted from the sensor 69, but the detection signal is not inputted from the sensor 70 (S111: YES, and S113: NO), the printer 100 and stacker 101 are in the fourth state as illustrated in FIG. 15, and have an unclear positional relationship. Causes for the fourth state are assumed to be the case when even though the devices are in the first state, no detection signal is inputted from the sensor 70, or even though the devices are in the second or third state, the detection signal is inputted from the sensor 69. In this case, the printer controller 201 displays an error on the display 203 without starting the printing operation (S116), and prompts the user to check the state of the sensors 69, 70. The printer controller 201 then rechecks the detection status of the sensors 69, 70 (S110). In the case of the second state or fourth state, a method was explained in which an error was displayed on the display 203, and then the detection status of the sensors 69, 70 was rechecked, however, it is also possible to recheck the status of the sensors 69, 70 without displaying an error. In other words, it is also possible to control the printer 100 so as to recheck the detection status of the sensors 69, 70 without notification of information related to the positional relationship between the printer 100 and the stacker 101.

In this way, the printer controller 201 determines from the detection results from the sensors whether the mode is the stacker mode, basket mode or neither mode. The printer controller 201 then controls the printing operation accordingly and properly discharges sheets 1 from the printer 100 to the stacker 101 or the basket 123. In the case of the second state or fourth state, by notifying the user without starting the printing operation, it is possible to prevent jammed sheets between the supply opening and the receiving opening. Moreover, by determining that the state is the fourth state, it becomes possible to prompt the user to check the status of the sensors.

Construction was explained above in which the printer controller 201 controls the printer 100 and starts the printing operation based on the detection results from the sensors. However, it is also possible to have the user start the printing operation after notifying the user of the detection results from the sensors and having the user check the sheet discharge method. Moreover, it is also possible to provide a controller in the stacker 101 that corresponds to the printer controller 201, and have that controller control the operation of the printer 100.

The case of using the contact type sensors was explained, however, the sensor detection method is not limited to this method. For example, it is also possible to use color-distinguishing sensors that can distinguish colors. In that case, colors that can be distinguished by the sensors are applied to portions that will be the object of detection. Moreover, the case of using the two sensors was explained, however, the number of sensors is not limited to two. Construction in which the sensors were located in the feet on the left side was explained, however, the sensors could also be located in the feet on the right side. That is, it is possible to provide the sensors that are located on either the left side or the right side. Further, construction in which the sensors were provided in both the printer and the stacker was explained, however it is also possible to provide the sensors in only one.

Moreover, it is also possible to provide a sensor for detecting the inclination of the side rod 126 for determining the state of the basket 123 (stored state or opened state), and control the printing operation according to the detection result from that sensor.

In this embodiment, the case of using the basket 123 as a discharge destination other than the stacker 101 was explained, however, it is also possible to discharge sheet to a work table and the like instead of the basket 123.

Moreover, the articles that are supplied (discharged) from the printer 100 are not limited to sheets for printing, and could be articles other than sheets. The supply device is not limited to the printer described above or a sheet supply device as will be described later in the third embodiment, and the receiving device is not limited to the stacker described above or a cutting device as will be described later in the third embodiment.

As was explained above, in the second state and third state, part of the feet of the receiving device rides up onto part of the feet of the supply device. The detection unit includes the first sensor that is provided on a foot of the receiving device and that detects the positional relationship with a foot of the supply device, and the second sensor that is provided on a foot of the supply device and that detects the positional relationship with a foot of the receiving device, and the detection unit detects the state from the output from the first sensor and the second sensor. In the second state, control is performed so that sheets are not conveyed to prevent sheets from jamming between the supply opening and the receiving opening. Moreover, in the fourth state as well, control is performed so that sheets are not conveyed, and prompts checking of the sensor states. In this way it is possible to properly supply sheets to the receiving device or to a desired supply destination such as the basket, and it is possible to prevent the jamming of sheets.

Next, a second embodiment of the present invention will be explained. In this embodiment, sensors are provided on both the left and right feet. The printer 100 will be controlled without notification of information related to the positional relationship between the printer 100 and the stacker 101. The other construction is the same as in the first embodiment, so an explanation thereof is omitted. In this embodiment, the sensor that was located on only the foot 61 on the left side of the stacker 101 in the first embodiment is also located on the outer surface of the support member 66 on the upstream side in the y direction of the foot 61 on the right side. Moreover, the sensor that was located only on the foot 111 on the left side of the printer 100 in the first embodiment is also located on the inner surface on the downstream side in the y direction of the foot 111 on the right side.

Figure 16:
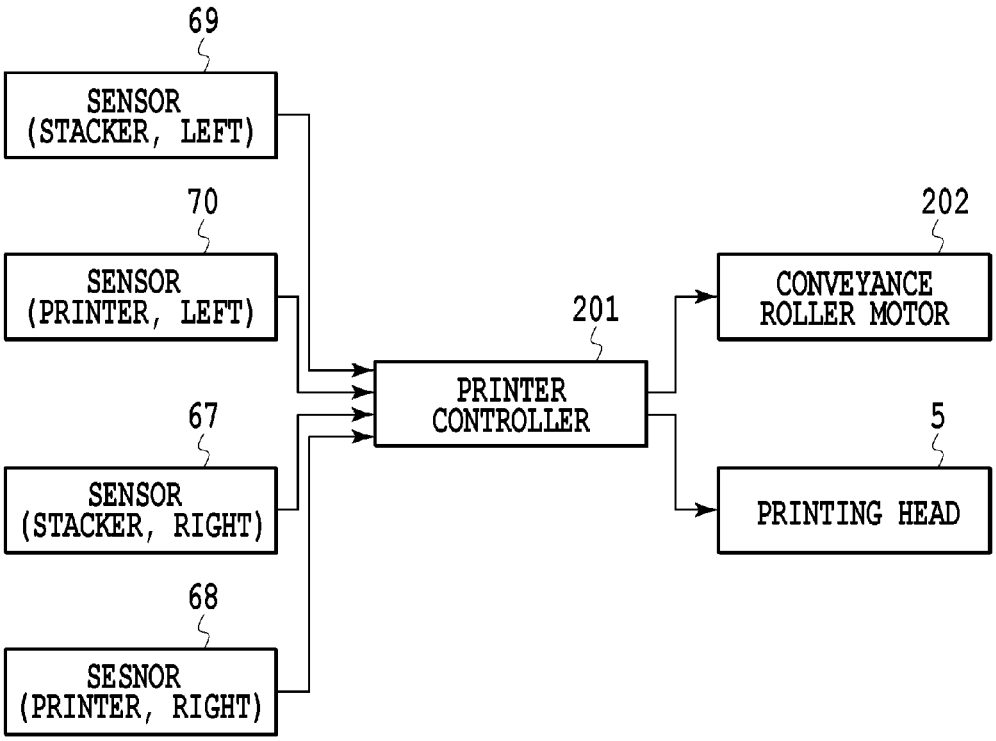
FIG. 16 is a block diagram illustrating the control configuration in a second embodiment.

FIG. 16 is a block diagram illustrating the construction of a control system. As illustrated in FIG. 16, in addition to the sensors 69, 70, sensors 67, 68 are connected to the printer controller 201. The sensor 67 is a sensor that is located on the foot 61 on the right side of the stacker 101, and the sensor 68 is a sensor that is located on the foot 111 on the right side of the printer 100. The printer controller 201 controls the printing operation according to the detection results from the sensors 67 to 70.

When joining together the printer 100 and the stacker 101, a state in which the stacker 101 is located diagonally with respect to the printer 100 can be imagined. In this case, in construction in which a sensor is provided on one foot on either the left or right, there is a possibility that the first state may be determined even in the case when only the side where the sensor is provided is joined, and the side where the sensor is not provided is not joined, so the printing operation may start. Therefore, sensors are provided on both the left and right feet, and the first state is determined for the left and right of the printer opening port 109 and stacker opening port 108. When both the left and right are joined, the printing operation is started, and sheets 1 can be properly discharged from the printer 100 to the stacker 101, or to the basket 123.

Figure 17:
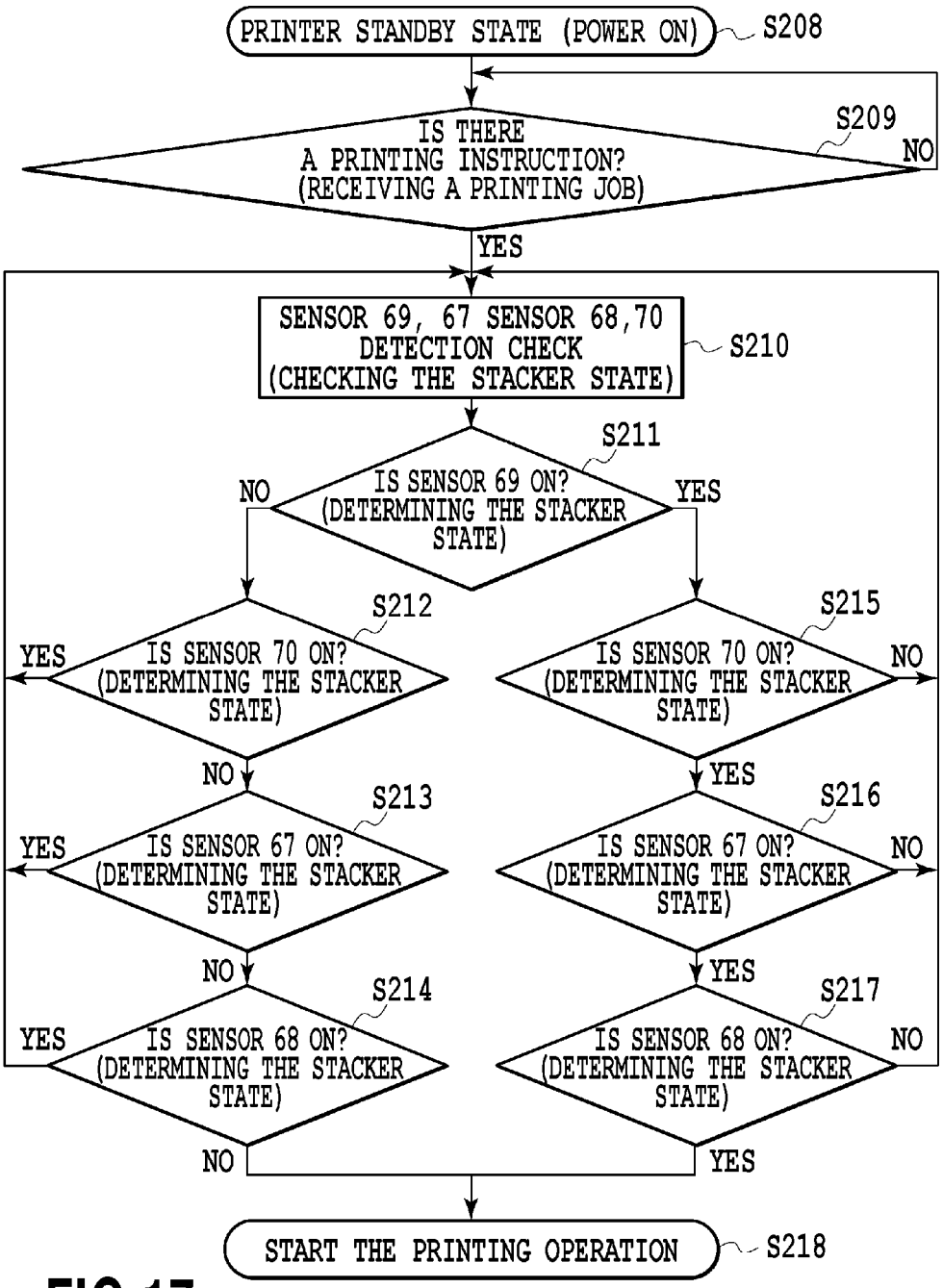
FIG. 17 is a flowchart illustrating processing up to the start of a printing operation in the second embodiment.

FIG. 17 is a flowchart illustrating the process up to the start of the printing operation. FIG. 18 is a table illustrating the relationship between the detection results from the respective sensors and the printing operation. The processing of S208 and S209 illustrated in FIG. 17 are the same as the processing of S108 and S109 illustrated in FIG. 14, so an explanation thereof is omitted. The printer controller 201 checks the detection status of the sensors 67 to 70 (S210). The printer controller 201 determines whether or not a detection signal was inputted from the sensor 69 (S211), and whether or not a detection signal was inputted from the sensor 70 (S212, S215). Moreover, the printer controller 201 determines whether or not a detection signal was inputted from the sensor 67 (S213, S216), and whether or not a detection signal was inputted from the sensor 68 (S214, S217).

When the detection signals were inputted from all of the sensors 67 to 70 (S211: YES, and S215 to S217: YES), the printer 100 and the stacker 101 are joined, that is, in the first state as illustrated in FIG. 18. In this case, the printer controller 201 starts the printing operation (S218). When no detection signal was inputted from any of the sensors 67 to 70 (S211: NO, and S212 to S214: NO), the printer 200 and the stacker 201 are separated, that is, in the third state as illustrated in FIG. 18. In this case, the printer controller 201 starts the printing operation (S218).

When the detection signal was inputted from any of the sensors 67 to 70 (S211: NO and at least one of S212 to S214: YES, or S211: YES, and at least one of S215 to S217: NO), the state is the second state or the fourth state. Therefore, the printer controller 201 does not start the printing operation, but rechecks the detection status of the sensors 67 to 70 (S210).

In this way, the printing operation is not started in the second state or the fourth state. Therefore, when the printing operation is not started even after a certain amount of time has elapsed since the power to the devices was turned ON and a printing instruction was given, the user can handle this by checking the positional relationship between the printer 100 and the stacker 101, or the sensor status, so that the desired processing is executed.

When the width (length in the x direction) of the printer 100 and the stacker 101 is comparatively large, it may be even more difficult to join together both ends in the width direction, and the printer 100 and the stacker 101 may become diagonally arranged. On that basis, by detecting the first state on the left and right, and starting the printing operation when both the left and right are joined or separated, it is possible to prevent a situation in which sheets 1 are not properly discharged due to only one side being joined or separated.

Next, the case in which a cutting device 120 and a sheet-supply device 122 are used will be explained as a third embodiment of the present invention. The other construction is the same as in the first embodiment, so an explanation thereof will be omitted. Here, the cutting device 120 is used instead of the stacker as a receiving device, and the sheet-supply device 122 is used instead of the printer as a supply device.

Figure 19:
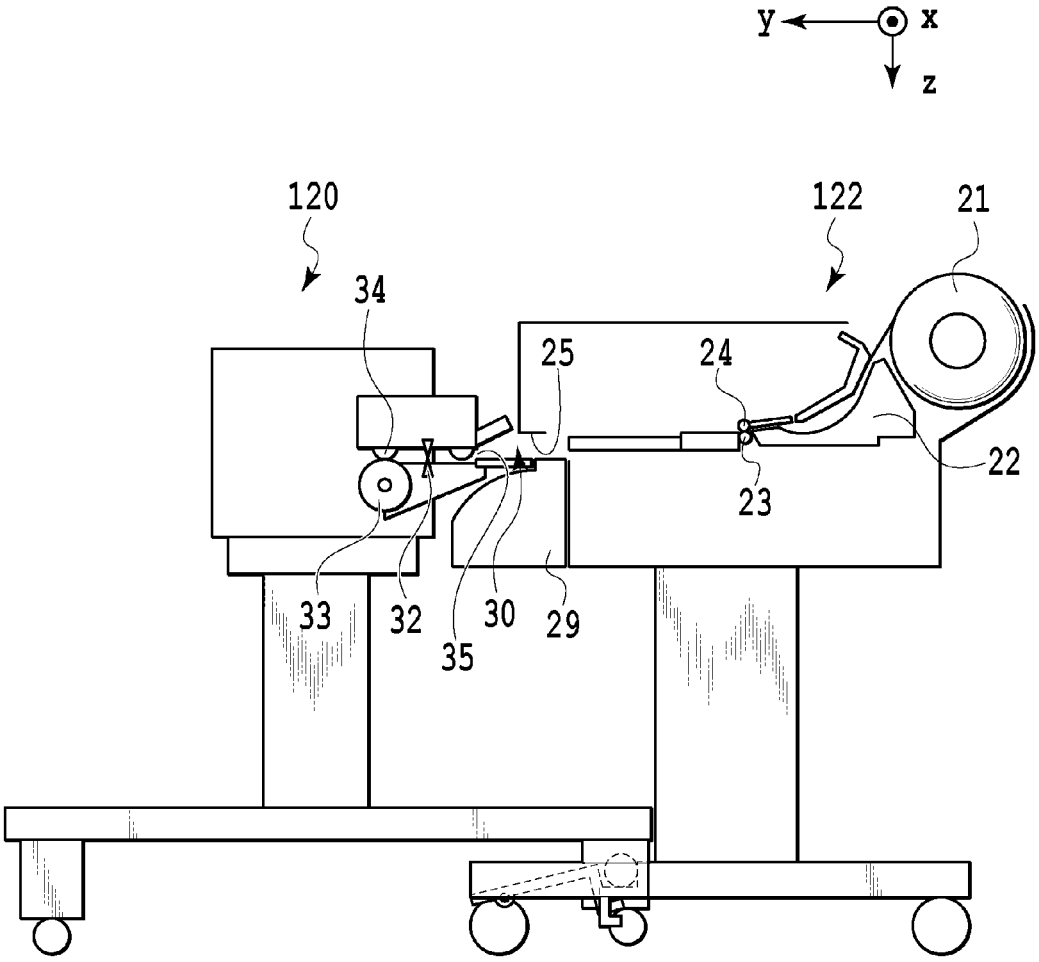
FIG. 19 is a side view illustrating a cutting device and a sheet-supply device in a third embodiment.

FIG. 19 is a side view illustrating the cutting device 120 and the sheet-supply device 122. As illustrated in FIG. 19, the sheet-supply device 122 comprises a path member 22, a conveyance roller 23, a pinch roller 24, and an opening 25. The cutting device 120 comprises a cutter 32, a conveyance roller 33, a pinch roller 34, and an opening 35. Sheets 21 are delivered from the sheet-supply device 122 to the cutting device 120.

A sheet 21 that is held in a roll shape is located on the upstream side in the y direction of the sheet-supply device 122. In the sheet-supply device 122, the tip end of the roll-shaped portion of the sheet 21 is pulled, and caused to pass through the path member 22, and then the sheet 21 is held between the conveyance roller 23 and the pinch roller 24. By making the pinch roller 24 rotate as the conveyance roller 23 rotates, the sheet 21 is conveyed toward the downstream side in the y direction and discharged from the opening 25 to the outside of the sheet-supply device 122, and the sheet 21 is supplied to the cutting device 120.

The opening 25 and the opening 35 are joined, and these form a joint 30. The sheet 21 that is supplied from the sheet-supply device 122 is conveyed by the rotation of the conveyance roller 23 from the opening 35 to inside the cutting device 120. After the sheet 21 has been conveyed to the cutting device 120, the conveyance roller 33 is rotated. The sheet 21 that reached the area between the conveyance roller 33 and the pinch roller 34 is held between these, and conveyed to the downstream side in the y direction. After a specified length has been conveyed, the cutter 32 then cuts the sheet 21. The cut sheet 21 is discharged to the outside of the cutting device 120, or in the case in which the cutting device 120 is provided with a tray, the sheet 21 is placed in the tray. When using a cutting device 120 in this way, sheets 21 can be supplied from the sheet-supply device 122 to the cutting device 120 by joining together the cutting device 120 and the sheet-supply device 122.

Depending on the material of the sheet 21 and the type of blade of the cutter 32 of the cutting device 120, the cutter 32 of the cutting device 120 might not be suitable for the sheet 21. In that case, the sheet 21 may be cut without using the cutting device 120. In the case where the cutting device 120 is not used, the cutting device 120 is separated from the sheet-supply device 122, and the sheet 21 is discharged along a guide 29 that is provided on the downstream side in the y direction of the sheet-supply device 122. The discharged sheet 21 is then cut by the user using cutting means other than the cutting device, such as scissors.

In this embodiment, the sheet-supply operation is started when the cutting device 120 and the sheet-supply device 122 are joined or separated. In this way, even when using devices other than a printer or a stacker, it is possible to suitably deliver or discharge articles by determining the joined or separated state of two devices. The controller of the sheet-supply device 122 controls a motor for driving the conveyance roller according to detection results from sensors. The controller of the sheet-supply device 122 controls the motor so as to rotate the conveyance roller 23 of the sheet-supply device 122 and the conveyance roller 33 of the cutting device 120 when it is determined from the detection results from the sensors that the state is the first state, or in other words, the state in which the cutting device 120 is used. The controller of the sheet-supply device 122 controls the motor so as to rotate only the conveyance roller 23 of the sheet-supply device 122 when it is determined from the detection results from the sensors that the state is the third state, or in other words, the state in which the cutting device 120 is not used. In this embodiment, it is also possible to provide sensors on the left and right as in the second embodiment.

Next, a fourth embodiment of the present invention will be explained. In this embodiment, the construction for supporting a basket 123 is different than that in the first embodiment. Moreover, a sensor that detects that the basket 123 is held in a specified position is used. The other construction is the same as in the first embodiment, so an explanation thereof is omitted.

Figure 20:
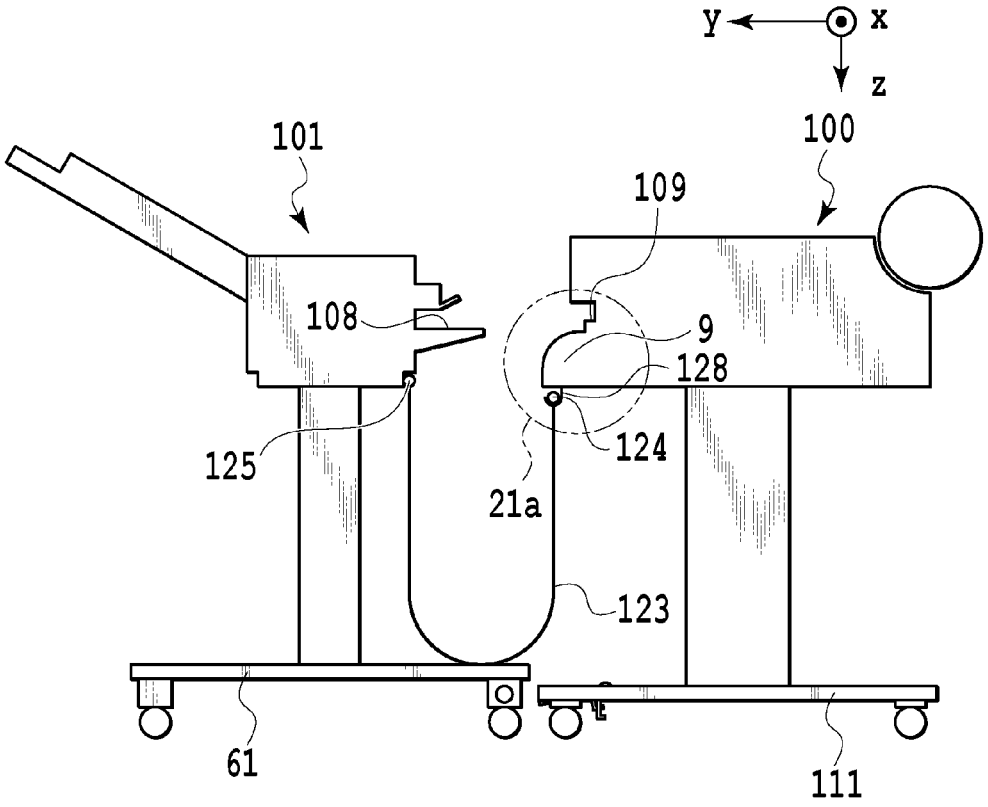
FIG. 20 is a side view illustrating a stacker and a printing apparatus in a fourth embodiment.

FIG. 20 is a side view illustrating a stacker 101 and a printer 100. As illustrated in FIG. 20, one end on the downstream side in the y direction of the basket 123 is supported by a downstream rod 125, and the other end on the upstream side in the y direction is supported by an upstream rod 124. The downstream rod 125, as in the first embodiment, is attached to the surface of the stacker 101 that faces the printer 100. On the other hand, the upstream rod 124 is supported by support members 128. The support members 128 are provided on the side of both ends in the x direction of the bottom surface on the downstream side in the y direction and further downward than the position of the discharge guide 9 of the printer 100. Moreover, the support members 128 have a substantially J shape as seen from the front in the figure in order to be able to support the upstream rod 124 so as to be attachable and detachable. A user sets the basket 123 by placing the upstream rod 124 in the support members 128. In both the cases of discharging sheet to the stacker 101, and discharging sheet to the basket 123, the upstream rod 124 is presumed to be supported by the support members 128.

In this construction, once the upstream rod 124 is removed from the support members 128, the user may forget to place the upstream rod 124 in the support members 128 again. Moreover, the upstream rod 124 may come apart from the support members 128 for some reason. Therefore, a sensor is used for detecting whether or not the upstream rod 124 is supported in the support members 128, or in other words, detecting whether or not the basket 123 is set, and the printing operation is controlled according to the detection result of this sensor.

Figure 21:
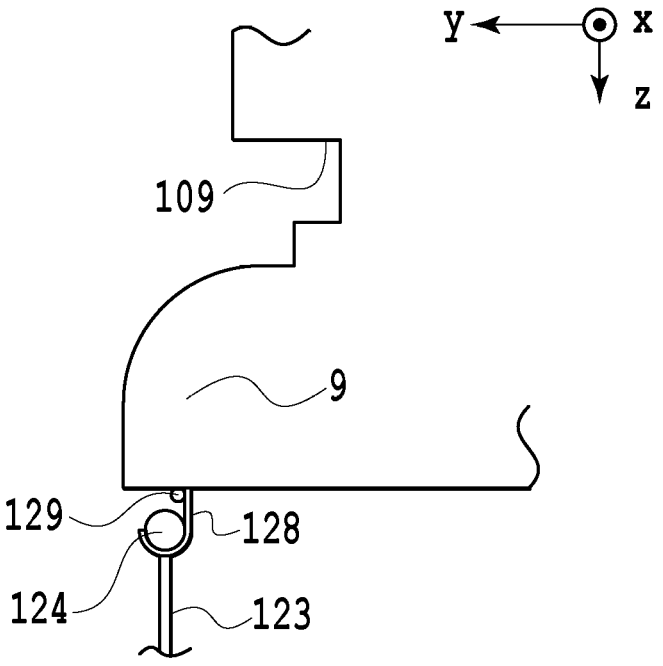
FIG. 21 is an enlarged view of the area indicated by the dashed line in FIG. 20.

FIG. 21 is an enlarged view of the dashed line area 21*a* in FIG. 20. As illustrated in FIG. 21, a sensor 129 is provided on the bottom surface of the printer 100. The sensor 129 is located at a position where the upstream rod 124 that is supported by the support members 128 can be detected, and detects whether or not the upstream rod 124 is supported by the support members 128. The sensor 129 that is provided on the bottom surface of the left side of the printer 100 could also be provided on the bottom surface of the right side of the printer 100 as long as the sensor 129 is provided in a position where the upstream rod 124 can be detected, or sensors 129 could be provided on the bottom surface on both the left and right sides.

When it is determined based on the detection results from the sensors 69, 70 that the state is the third state, the printer controller 201 controls the printing operation according to the detection result from the sensor 129. More specifically, when the upstream rod 124 is supported by the support members 128, the printer controller 201 starts the printing operation, and when the upstream rod 124 is not supported by the support members 128, does not start the printing operation. As a result, in the third state it is possible to prevent sheets 1 from dropping to a floor due to the basket 123 not being properly set. When the upstream rod 124 is not supported by the support members 128, it is also possible to have the printer controller 201 notify the user that the upstream rod 124 is not supported.

By using the sensor 129 in addition to the sensors 69, 70 in this way, it is possible to suitably discharge sheets 1 to the basket 123 in the third state.

Construction in which the support members that support the rod are provided on the printer 100 side was explained above, however, it is also possible to provide support members on the stacker 101 side. In this case, the basket 123 is set by attaching the upstream rod 124 to the printer 100, providing the support members on the stacker 101, and placing the downstream rod 125 in the support members so as to be attachable and detachable. Moreover, in this case, a sensor for determining whether or not the downstream rod 125 is supported by the support members is provided on the stacker 101 side. It is also possible to provide sensors on both the left and right feet as in the second embodiment.

Next, a fifth embodiment of the present invention will be explained. In this embodiment, in the first state, the state of the stacker 101 and the cutting method of the sheets is checked. The other construction is the same as in the first embodiment, so an explanation thereof is omitted.

Figure 22:
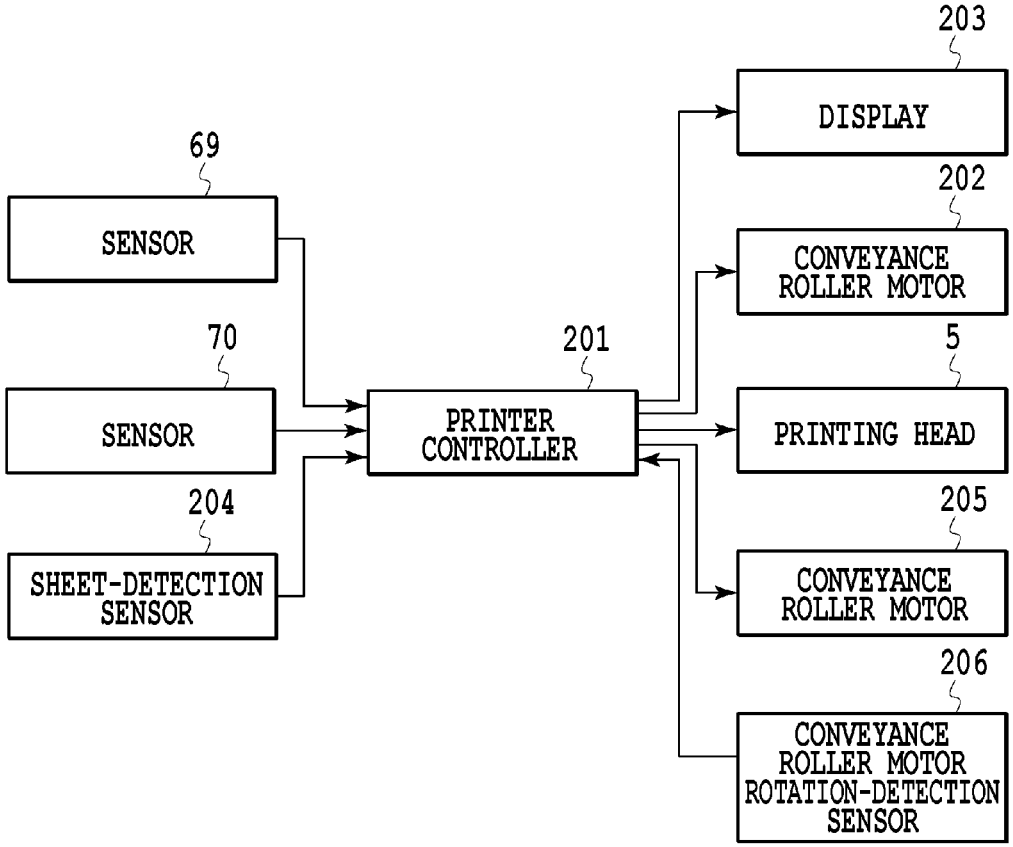
FIG. 22 is a block diagram illustrating the control configuration in a fifth embodiment.

FIG. 22 is a block diagram illustrating the construction of a control system. In addition to the construction illustrated in FIG. 13, a sheet-detection sensor 204, a conveyance roller motor 205, and a conveyance roller motor rotation-detection sensor (hereafter, referred to as a "rotation-detection sensor" 206 are connected to the printer controller 201. Signals from these sensors are also inputted to the printer controller 201. The sheet-detection sensor 204 is provided in the stacker 101 and detects whether or not there are sheets in the stacker 101. The conveyance roller motor 205 is a motor for driving the conveyance roller 12 of the stacker 101. The rotation-detection sensor 206 detects the rotation of the conveyance roller motor 205.

Figure 23:
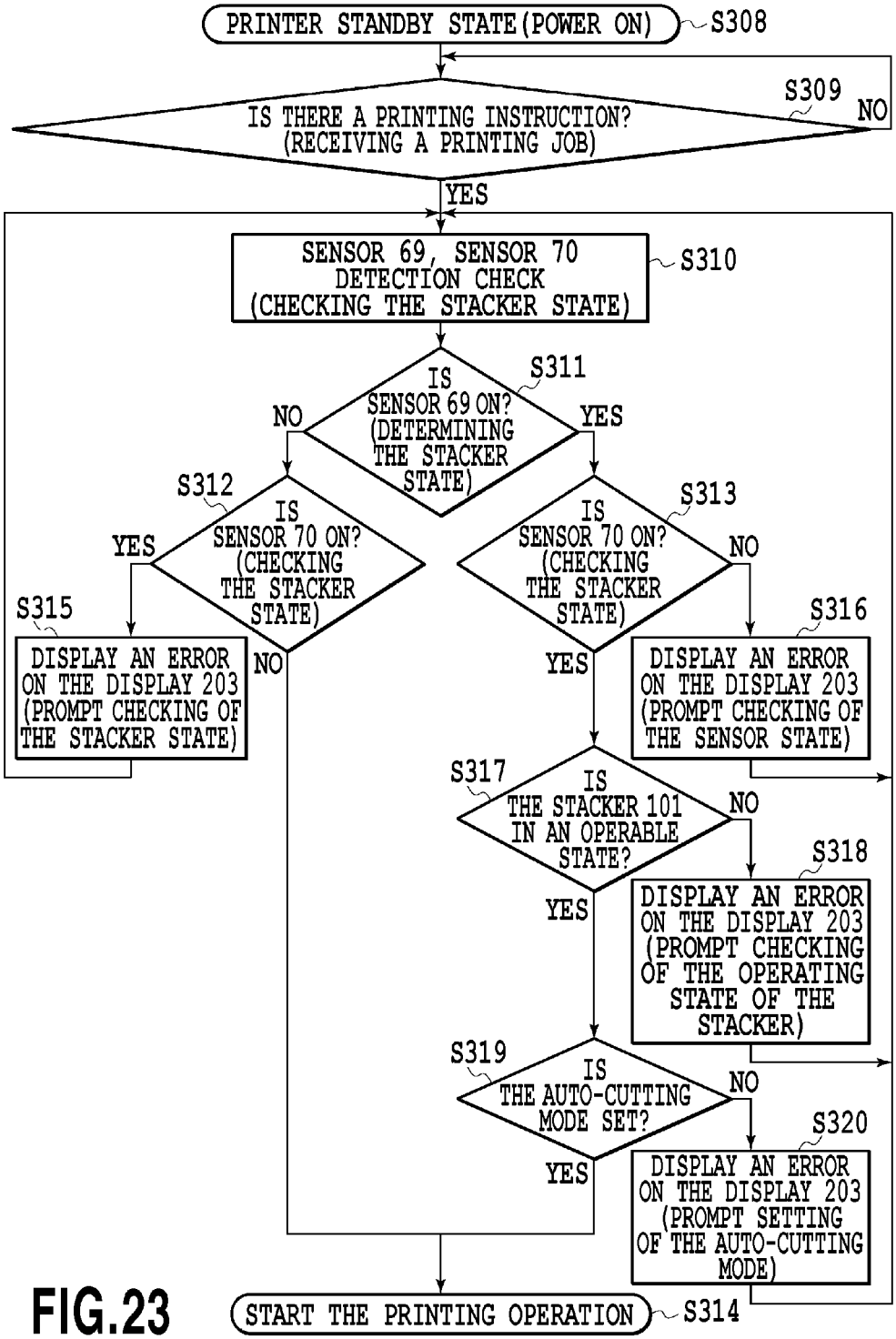
FIG. 23 is a flowchart illustrating processing up to the start of a printing operation in the fifth embodiment.

FIG. 23 is a flowchart illustrating the processing up to the start of the printing operation. The processing from S308 to S316 illustrated in FIG. 23 is the same as the processing from S108 to S116 explained in FIG. 13, so an explanation thereof is omitted here. When detection signals are inputted from the sensors 69, 70 (S311: YES, and S313: YES), the printer 100 and the stacker 101 are in the first state, so sheets are discharged from the printer 100 to the stacker 101. For this reason, the printer controller 201 determines whether or not the stacker 101 is in an operable state (S317).

Here, the operable state of the stacker 101 is when sheets are not stacked in the stacker 101 and the conveyance roller 12 of the stacker 101 is in a rotatable state. When the next sheet is discharged from the printer 100 to the stacker 101 with sheets stacked in the stacker 101, there is a possibility that the next sheet will get caught on the sheets stacked in the tray 16 and the sheet will become jammed between the supply opening and the discharge opening. Moreover, there is also a possibility that the next sheet will come into contact with the sheets stacked in the tray 16 and that the ink applied to the sheet will rub and the image quality will drop. When for some reason the conveyance roller 12 is not able to rotate, there is a possibility that a sheet being discharged from the printer 100 will not be conveyed toward the tray 16 and a sheet jam will occur. Therefore, determining whether or not the stacker 101 is in the operable state is performed by detecting whether or not there are sheets in the stacker 101, and whether or not the conveyance roller 12 is in the rotatable state. The printer controller 201 determines whether or not the stacker 101 is in the operable state based on signals that are outputted from the sheet-detection sensor 204 and the rotation-detection sensor 206.

When the stacker 101 is not in the operable state (S317: NO), the printer controller 201 displays an error on the display 203 (S318) and prompts a user to check the operating state of the stacker 101. As a result, when there are sheets in the stacker 101, the user can perform the task of removing the sheets, and when the conveyance roller 12 is not rotating, the user can perform the task of switching the discharge destination to the basket 123. The printer controller 201 then rechecks the detection status of the sensors 69, 70 (S310).

When the stacker 101 is in the operable state (S317: YES), the printer controller 201 determines whether or not the user has selected the auto-cutting mode for the cutter 8 to cut the sheets (S319). The auto-cutting mode is selected by the user by using switches that are provided on a control unit for the printer 100. In the first state, the printer 100 and the stacker 101 are joined and it is difficult to maintain enough space for the user to cut the sheets using a cutting method other than the cutter 8, so the sheets are cut using the cutter 8. For this reason, the printer controller 201 determines whether or not the auto-cutting mode is selected.

When the auto-cutting mode is not selected (S319: NO), the printer controller 201 displays an error on the display 203 and prompts the user to select the auto-cutting mode. As a result, the user selects the auto-cutting mode when it is desired to cut sheets using the cutter 8. On the other hand, when the user desires to cut sheets using a cutting method other than the cutter 8, the user performs the task of separating the printer 100 and the stacker 101. Then the printer controller 201 rechecks the detection status of the sensors 69, 70 (S310). When the auto-cutting mode is selected (S319: YES), the printer controller 201 starts the printing operation (S314).

As described above, in this embodiment, when the printer 100 and the stacker 101 are in the first state, the printer controller 201 determines whether or not the stacker 101 is in the operable state, and whether or not the auto-cutting mode is selected. As a result, it is possible to prevent sheet jams. When using cut sheets, the process for determining whether or not the auto-cutting mode is selected is omitted.

Next, a sixth embodiment of the present invention will be explained. In this embodiment, a controller is also provided in the stacker 101, and electric power is also supplied together with control signals from the printer 100 to the stacker 101 by way of an electrical cable. The other construction is the same as in the first embodiment, so an explanation thereof is omitted.

Figure 24:
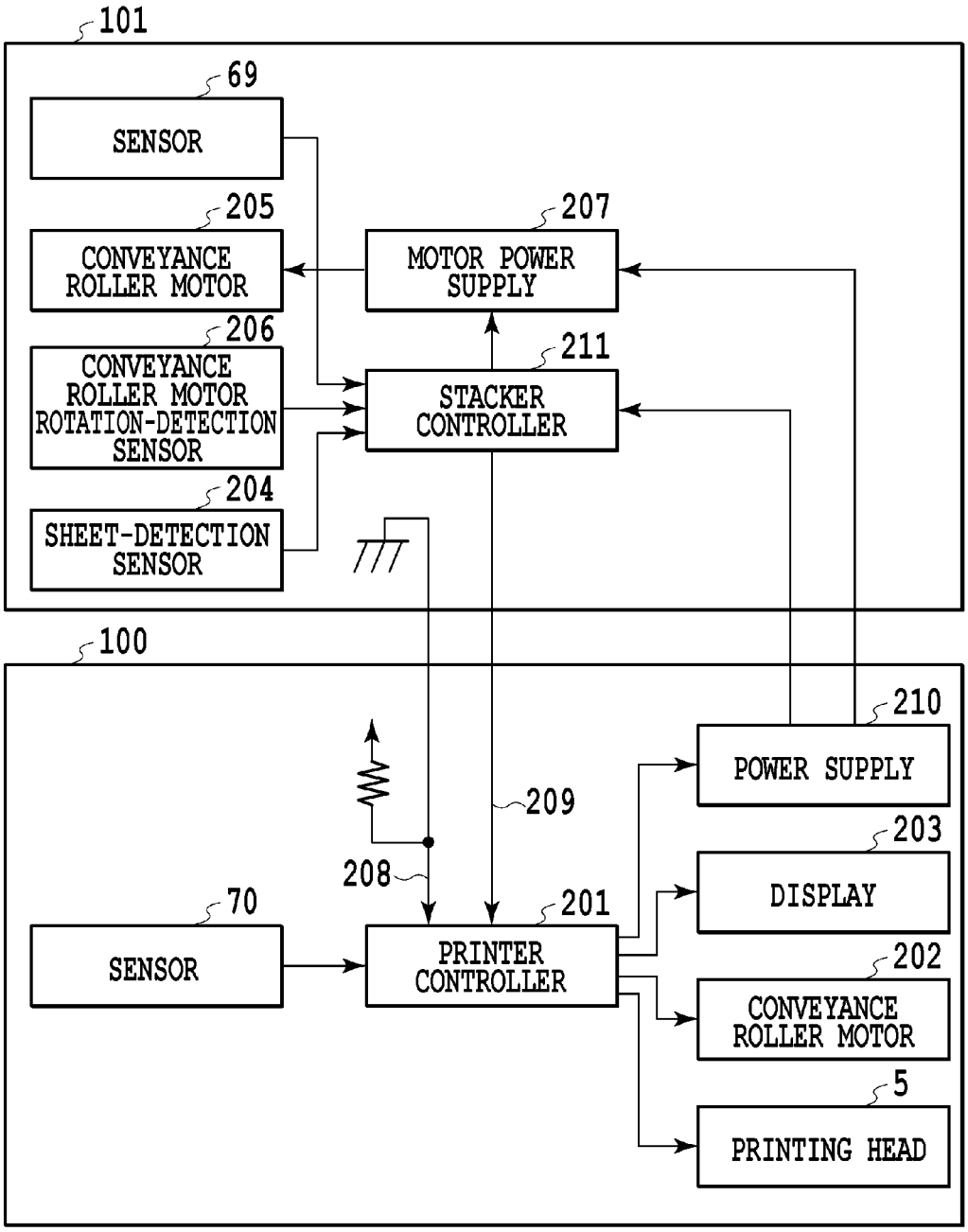
FIG. 24 is a block diagram illustrating the control configuration in a sixth embodiment.

FIG. 24 is a block diagram illustrating the construction of a control system. A stacker controller 211 is a controller that performs overall control of the stacker 101, and is connected to the sensor 69, the conveyance roller motor 205, the rotation-detection sensor 206, the sheet-detection sensor 204, and a motor power supply 207. The printer controller 201 is connected to the sensor 70, the printing head 5, the conveyance roller motor 202, the display 203, and the power supply 210.

When the stacker 101 is connected to the printer 100 to which the power supply is ON, or when the power to the printer 100 is turned ON with the stacker 101 being connected, a connection signal 208 is inputted to the printer controller 201. After the connection signal 208 has been inputted, the printer controller 201 controls the power supply 210 so that electric power is supplied to the stacker controller 211 and the motor power supply 207.

Figure 25:
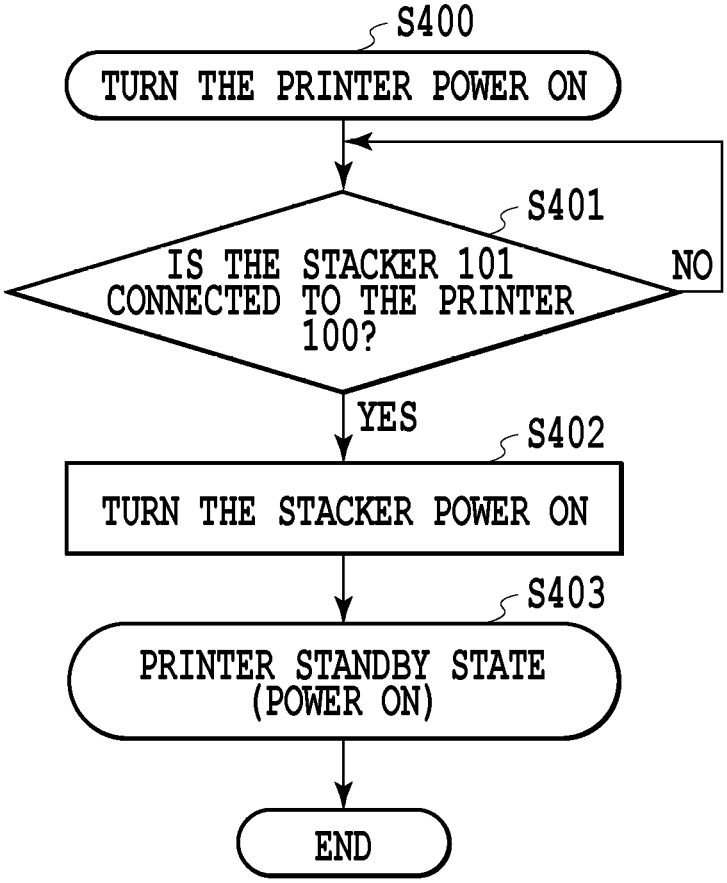
FIG. 25 is a flowchart illustrating processing up to a standby state in the sixth embodiment.

When a detection signal is inputted from the sensor 69, the stacker controller 211 controls the conveyance roller motor 205 by way of the motor power supply 207 based on the detection signal from the sheet-detection sensor 204. The sheet-detection sensor 204 is constructed so as to output the detection signal when a sheet is detected. When the detection signal is outputted from the sheet-detection sensor 204, or in other words, when a sheet is stacked in the stacker 101, the stacker controller 211 controls the motor power supply 207 so that the conveyance roller motor 205 is not driven until the sheet is removed. In this case, an operation check signal 209 that indicates that the stacker 101 is not in the operable state is inputted from the stacker controller 211 to the printer controller 201. On the other hand, when the detection signal is not outputted from the sheet-detection sensor 204, or in other words, when there is no sheet stacked in the stacker 101, the stacker controller 211 drives the conveyance roller motor 205 by way of the motor power supply 207. The conveyance roller motor 205 rotates, and when the rotation-detection sensor 206 detects that rotation, a signal is inputted from the rotation-detection sensor 206 to the stacker controller 211 indicating that rotation of the conveyance roller motor 205 was detected. In this case, an operation check signal 209 that indicates that the stacker 101 is in the operable state is inputted from the stacker controller 211 to the printer controller 201. The operation check signal 209 also includes information about the detection result from the sensor 69. FIG. 25 is a flowchart illustrating the flow of processing up to the printer standby state. When a user turns ON the power to the printer 100 (S400), the printer controller 201 supplies electric power to the members of the printer 100. Next, the printer controller 201 determines whether or not the printer 100 and the stacker 101 are connected by the cable 200 (S401). More specifically, the printer controller 201 determines whether or not the printer 100 and the stacker 101 are connected by the cable 200 according to whether or not the connection signal 208 is inputted.

When a stacker connection signal is not inputted, and the stacker 101 is not connected to the printer 100 (S401: NO), the checking process will be continued until there is a connection. When the stacker connection signal is inputted and the stacker 101 is connected to the printer 100 (S401: YES), the printer controller 201 turns the power ON to the stacker 101. More specifically, the printer controller 201 controls the power supply 210 and supplies electric power to the stacker controller 211 and the motor power supply 207. The printer controller 201 acquires detection results from the sensors on the stacker 101 side from the operation check signal 209 that is inputted from the stacker controller 211, and controls all of the members base on those results. In this way, the printer controller 201 checks whether or not the printer 100 and stacker 101 are connected, and turns the power ON to the stacker 101 when connected.

Determining whether or not the printer 100 and the stacker 101 are connected by the cable 200 is presumed to be executed at specified timing even after the standby state is set. When it is determined after the standby state is set that the printer 100 and the stacker 101 are not connected, the printer controller 201 controls the power supply 210 and stops supplying power to the stacker 101. In the case that the printer 100 and stacker 101 become disconnected due to a disconnected cable 200 or the like after the printer 100 and the stacker 101 have been connected, the printer controller 201 stops the supply of power to the stacker 101.

Figure 26:
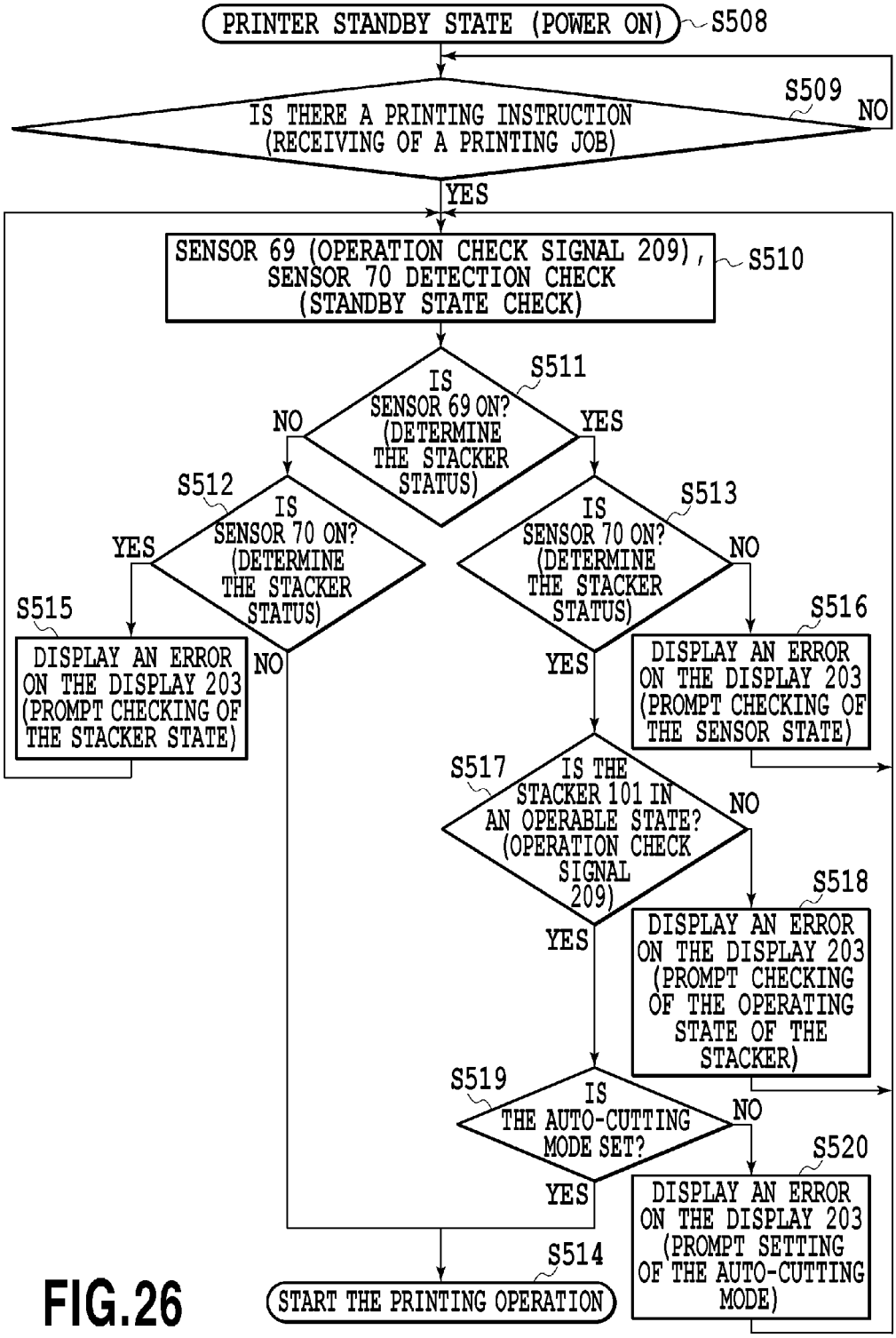
FIG. 26 is a flowchart illustrating processing up to the start of a printing operation in the sixth embodiment.

FIG. 26 is a flowchart illustrating the processing up to the start of the printing operation. FIG. 27 is a table illustrating the relationship among detection results from the sensors 69, 70, the operating state of the stacker 101, and the printing operation. The processing in S508 and S509 illustrated in FIG. 26 is the same as the processing in S308 and S309 illustrated in FIG. 23, and the processing from S512 to S516, and from S518 to S520 illustrated in FIG. 26 is the same as the processing from S412 to S416, and from S418 to S420 illustrated in FIG. 23, so an explanation thereof is omitted.

When a printing job has been received (S509: YES), the printer controller 201 checks the detection status of the sensors 69, 70 (S510). Here, the printer controller 201 determines whether or not the detection signal has been inputted from the sensor 69 based on the operation check signal 209 (S511). When the detection signals have been inputted from both of the sensors 69, 70 (S511: YES, and S513: YES), the printer controller 201 determines, based on the operation check signal 209, whether or not the stacker 101 is in the operable state (S517).

In this way, the printer controller 201 acquires information from the operation check signal 209 about the detection results of the sensors on the stacker 101 side. As a result, when compared with the construction illustrated in FIG. 22, it is possible to reduce the number of members that are directly connected to the printer controller 201, and thus it is possible to keep signal lines in the printer 100 from becoming complex. Moreover, the printer controller 201 determines whether or not the printer 100 and the stacker 101 are connected according to whether or not the connection signal 208 has been inputted. When the printer 100 and the stacker 101 are not connected, the printer controller 201 stops the supply of power from the printer 100 to the stacker 101.

Construction is not limited to the form of supplying power from the printer 100 to the stacker 101 by way of the cable 200, and conversely, construction is also possible in which power is supplied from the stacker 101 to the printer 100 by way of the cable 200. The cable 200 is flexible, so maintaining the cable connection when the stacker 101 and the printer 100 are close or separated is the same as in the other embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-200733, filed Sep. 30, 2014, No. 2015-033146, filed Feb. 23, 2015 which are hereby incorporated by reference wherein in their entirety.

What is claimed is:

1. A delivery system comprising:

a supply device having a supply port for supplying an article;

a receiving device having a receiving port configured to receive the article supplied from the supply port; and a detection unit configured to detect:

a first state in which the supply device and the receiving device are joined by the supply port engaging with the receiving port;

a second state in which the supply device and the receiving device are close together and there is a space between the supply port and the receiving port; and a third state in which the supply device and the receiving device are separated and a space between the devices is wider than in the second state.

2. The delivery system according to claim 1, wherein in the second state and the third state, part of a foot of the receiving device rides up on part of a foot of the supply device, and the detection unit includes a first sensor that is provided on the foot of the receiving device and detects a positional relationship with the foot of the supply device, and a second sensor that is provided on the foot of the supply device and detects a positional relationship with the foot of the receiving device; and detects a state from output from the first sensor and the second sensor.

3. The delivery system according to claim 2, wherein in the first state, detection signals are outputted from the first sensor and the second sensor, in the second state, the detection signal is not outputted from the first sensor, and the detection signal is outputted from the second sensor, and in the third state, no detection signal is outputted from either the first sensor or the second sensor.

4. The delivery system according to claim 3, wherein the detection unit is further configured to detect a fourth state in which a positional relationship between the supply device and the receiving device is unclear, and in the fourth state, the detection signal is outputted from the first sensor and the detection signal is not outputted from the second sensor.

5. The delivery system according to claim 1, further comprising a controller that controls the supply device so that an article is supplied from the supply port in the first state or in the third state.

6. The delivery system according to claim 5, wherein the controller controls the supply device so that when an article is supplied from the supply port when in the first state, the receiving device is in a state capable of receiving an article.

7. The delivery system according to claim 1, wherein the supply device is a printer that prints an image on a sheet as the article, and the receiving device is a stacker that stacks a printed sheet.

8. The delivery system according to claim 7, further comprising a storage unit that is arranged in a space between the supply device and the receiving device, and stores a sheet supplied from the supply port, the sheet dropping without passing through the receiving device.

9. The delivery system according to claim 8, wherein the receiving device is equipped with a stacking unit in which sheets are stacked, and in the first state sheets supplied from the supply port pass through the receiving port and are stacked in the stacking unit, and in the third state, sheets supplied from the supply port drop into the storage unit without passing through the receiving port.

10. The delivery system according to claim 9, wherein the storage unit is equipped with a basket that is formed using a flexible belt-shaped member, with one end of the belt-shaped member being attached to the receiving device, and the other end being attached to the supply device.

11. The delivery system according to claim 1, wherein the supply device and the receiving device are electrically connected by a cable connection, and the cable connection is maintained in any of the first state, the second state, and the third state.

12. A delivery system comprising:

a supply device having a supply port for supplying an article;

a receiving device having a receiving port configured to receive the article that is supplied from the supply port; and a storage unit that is arranged between the supply device and the receiving device and stores sheets that are supplied from the supply port, wherein the system is configured to have a first state in which the supply port and the receiving port engage and the supply device and the receiving device are joined, and to have a second state in which the supply device and the receiving device are separated, and in the first state, sheets that are supplied from the supply port are delivered by way of the receiving port, and in the second state, sheets drop into and are stored in the storage unit without passing through the receiving port.

13. The delivery system according to claim 12, wherein the storage unit is equipped with a basket that is formed using a flexible belt-shaped member, with one end of the belt-shaped member being attach to the receiving device, and the other end being attached to the supply device.

14. A delivery system comprising:

a supply device having a supply port for supplying an article; and a receiving device having a receiving port configured to receive the article that is supplied from the supply port, wherein the system is configured to have a first state in which the supply port and the receiving port engage and the supply device and the receiving device are joined, and to have a second state in which the supply device and the receiving device are separated, and the supply device and the receiving device are electrically connected by a cable connection, with the cable connection being maintained in both the first state and the second state, and electric power is supplied by way of the cable connection from the supply device to the receiving device, or from the receiving device to the supply device.

* * * * *